US008690394B2

(12) United States Patent
Sakai et al.

(10) Patent No.: US 8,690,394 B2
(45) Date of Patent: Apr. 8, 2014

(54) ILLUMINATING DEVICE FOR REDUCING UNEVENNESS IN ILLUMINANCE ON AN IRRADIATION TARGET FACE

(75) Inventors: Norihiro Sakai, Gyoda (JP); Tomohiro Iwazaki, Gyoda (JP); Kazuo Sakuma, Gyoda (JP); Ichirou Mori, Gyoda (JP); Masaki Kanai, Gyoda (JP); Maki Takenaga, Gyoda (JP); Hiroyuki Ootsuka, Gyoda (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 144 days.

(21) Appl. No.: 13/322,821

(22) PCT Filed: May 20, 2010

(86) PCT No.: PCT/JP2010/003408
§ 371 (c)(1), (2), (4) Date: Nov. 28, 2011

(87) PCT Pub. No.: WO2011/001592
PCT Pub. Date: Jan. 6, 2011

(65) Prior Publication Data

US 2012/0069578 A1 Mar. 22, 2012

(30) Foreign Application Priority Data

Jun. 30, 2009 (JP) ..... 2009-154604

(51) Int. Cl.
*F21V 7/00* (2006.01)
*F21V 5/02* (2006.01)
*F21V 9/02* (2006.01)

(52) U.S. Cl.
USPC ..... 362/307; 362/308; 362/209; 362/296.01

(58) Field of Classification Search
USPC ..... 362/362, 296.01, 241, 307, 308
See application file for complete search history.

(56) References Cited

U.S. PATENT DOCUMENTS 6,227,684 B1 * 5/2001 Wijbenga et al. ..... 362/310
6,992,828 B2 * 1/2006 He et al. ..... 359/599

(Continued)

FOREIGN PATENT DOCUMENTS

JP 63-56512 U 4/1988
JP 7-161212 A 6/1995
JP 2006-216619 A 8/2006
JP 2007-250489 A 9/2007

OTHER PUBLICATIONS

Machine English translation of JP 07-161212 to Shuichi published Jun. 23, 1995.*

(Continued)

*Primary Examiner* — Sikha Roy
(74) *Attorney, Agent, or Firm* — Westerman, Hattori, Daniels & Adrian, LLP

(57) ABSTRACT

An illuminating device that can reduce illuminance unevenness of an irradiation target face with a simple construction is provided. In a pseudo sunlight illuminating device 1 having a lamp 22 for illuminating an irradiation target face 10A, a transmission light amount adjusting unit 60 for adjusting a transmission light amount so that the illuminance distribution on the irradiation target face 10*a* is made uniform is provided between the lamp 22 and the irradiation target face 10A, and the transmission light amount adjusting unit 60 is provided with a light transmission plate laminate member 64 which is constructed by stacking light transmission plates 65 which are constant in transmittance in a wavelength range of light to be transmitted and whose number corresponds to an adjustment amount of the transmission light amount so that incident light is reflected at each boundary of the front and back surfaces of each light transmission plate 65.

10 Claims, 17 Drawing Sheets

(56) References Cited

U.S. PATENT DOCUMENTS

| | | | | |
|---|---|---|---|---|
| 7,072,096 | B2 * | 7/2006 | Holman et al. | 359/298 |
| 7,528,615 | B2 | 5/2009 | Shimotomai | |
| 8,040,461 | B2 * | 10/2011 | Lin et al. | 349/64 |
| 2005/0265029 | A1 * | 12/2005 | Epstein et al. | 362/339 |
| 2006/0087866 | A1 * | 4/2006 | Ng et al. | 362/612 |
| 2007/0171671 | A1 * | 7/2007 | Kurokawa et al. | 362/606 |
| 2007/0183137 | A1 * | 8/2007 | Iwasaki | 362/97 |
| 2008/0223441 | A1 * | 9/2008 | Jungwirth | 136/259 |
| 2010/0033954 | A1 * | 2/2010 | Boonekamp et al. | 362/97.1 |

OTHER PUBLICATIONS

Machine English translation of JP 2007-250489 to Tadashi published Sep. 27, 2007.*

Notification of Transmittal of Translation of the International Preliminary Report on Patentability (Form PCT/IB/338) of International Application No. PCT/JP2010/003408 mailed Feb. 23, 2012 with Forms PCT/IB/373 and PCT/ISA/237.

International Search Report for PCT/JP2010/003408, date of mailing Jul. 20, 2010.

* cited by examiner (A)

| EXPERIMENTS | 400mm POSITION DIFFUSION PLATE | 300mm POSITION DIFFUSION PLATE | 200mm POSITION DIFFUSION PLATE | UNEVENNESS OF ILLUMINANCE (%) |
|---|---|---|---|---|
| E1 | ○(P1×2) | — | — | 14.9 |
| E2 | ○(P2×2) | — | — | 13.4 |
| E3 | ○(P1) | — | ○(P3) | 6.7 |
| E4 | ○(P2) | — | ○(P3) | 4.9 |
| E5 | ○(P1) | ○(P3) | — | 15.6 |
| E6 | ○(P2) | ○(P3) | — | 15.1 |
| E7 | ○(P2) | ○(P2) | — | 16.0 |

(B)

| DIFFUSION PLATE | THICKNESS | OPTICAL DIFFUSION EFFECT |
|---|---|---|
| P1 | 270 μm | HAZE 89% |
| P2 | 3mm | OPTICAL DIFFUSION COEFFICIENT 0.37 |
| P3 | 3mm | OPTICAL DIFFUSION COEFFICIENT 0.13 |

(C)

(A)

(B)

ILLUMINATING DEVICE FOR REDUCING UNEVENNESS IN ILLUMINANCE ON AN IRRADIATION TARGET FACE

TECHNICAL FIELD

The present invention relates to an illuminating device, and particularly to a technique of reducing unevenness in illuminance on an irradiation target face.

BACKGROUND ART

There is known a pseudo sunlight irradiation device (called as solar simulator) for irradiating an irradiation target face of solar energy using equipment with pseudo sunlight reproducing the luminance emission spectrum of natural sunlight for the purpose of performance measurement of various kinds of solar energy using equipment represented by solar batteries, an accelerated deterioration test, etc. With respect to this type of pseudo sunlight irradiation device, there is known a technique of virtually dividing the whole area of the irradiation target face into plural sections and disposing a selected light amount adjusting member in each section so that the illuminance based on the pseudo sunlight irradiation device is made uniform every section and then the irradiation target face is irradiated, thereby eliminating unevenness in illuminance on an irradiation target face and thus enhancing the precision of performance measurement, the accelerated deterioration test, etc. A light shielding net, a light shielding tape or a light shielding sheet which varies in light shielding rate is used as the light amount adjusting member (see Patent Document 1, for example).

PRIOR ART DOCUMENT

Patent Document 1: JP-A-2006-216619

SUMMARY OF THE INVENTION

Problem to be Solved by the Invention

However, when a light shielding net or the like is used as the light amount adjusting member, alight shielding portion generates shadow on the irradiation target face, which may cause unevenness in illuminance. This problem may be considered to be solved not by shielding light to adjust the light amount, but by using, as the light adjusting member, a transmission type optical filter for absorbing and attenuating transmitted light. However, when a transmission type optical filter plate is used, it is necessary to prepare a transmission type optical filter plate whose transmittance corresponds to the adjustment amount of the transmission light amount, and thus there is a problem that this increases the cost and takes a lot of trouble.

This problem is not limited to the pseudo sunlight irradiating device, but it is also common to an illuminating device to which unevenness in illuminance on an irradiation target face is required to be reduced.

The present invention has been implemented in view of the foregoing situation, and has an object to provide an illuminating device that can reduce unevenness in illuminance on an irradiation target face with a simple construction.

Means of Solving the Problem

In order to attain the above object, according to the present invention, an illuminating device having a light source for illuminating an irradiation target face with light is characterized in that a transmission light amount adjusting unit for adjusting a transmission light amount so as to make an illuminance distribution on the irradiation target face uniform is provided between the light source and the irradiation target face, and the transmission light amount adjusting unit is provided with a light transmission plate laminate member having light transmission plates that are constant in transmittance in a wavelength range of light to be transmitted therethrough and stacked by a stack number corresponding to an adjustment amount of the transmission light amount so as to reflect incident light at each boundary of front and back surfaces of each of the light transmission plates.

According to the present invention, in the above illuminating device, each of the light transmission plates is configured to be thinner in accordance with the stack number so that the whole thickness of the light transmission plate laminate member is constant, the light transmission plate laminate member is disposed at each position where the transmission light amount is to be adjusted, a single light transmission plate configured to have the same thickness as the light transmission plate laminate member is disposed in a gap between the light transmission plate laminate members, the light transmission plate laminate members and the single light transmission plate are paved in a range through which the light to be illuminated to the irradiation target face passes, and a spacer member for preventing positional displacement of the light transmission plate laminate members and the single light transmission plate is provided around a range paved with the light transmission plate laminate members and the single light transmission plate.

According to the present invention, the above illuminating device further comprises a press member that covers and presses the surface of each of the light transmission plate laminate members and the single light transmission plate.

According to the present invention, an illuminating device having a light source for illuminating an irradiation target face with light is characterized in that a light diffusion unit for diffusing light so as to make an illuminance distribution on the irradiation target face uniform is provided between the light source and the irradiation target face, and two-layer light diffusion members are disposed to be spaced from each other to construct the light diffusion unit.

According to the present invention, in the above illuminating device, a plurality of reflection plates are arranged in parallel at the opposite side to the irradiation target face with respect to the light source to constitute a reflection face, direct light emitted directly from the light source and reflection light reflected from the reflection face are applied to the irradiation target face, and the two-layer light diffusion members are disposed to be spaced from each other at such a distance that boundaries of the plurality of reflection plates are inconspicuous.

According to the present invention, in the above illuminating device, the light diffusion member at the light source side out of the two-layer light diffusion members is provided with an illuminance adjusting plate for adjusting local illuminance unevenness.

According to the present invention, in the above illuminating device, an auxiliary reflection face for reflecting to the irradiation target face light which is a part of light emitted from the light source and travels to a location out of the irradiation target face is disposed between the light source at the side of the device and the irradiation target face.

This specification contains the whole content of Japanese Patent Application No. 2009-154604 filed on Jun. 30, 2009.

Effect of the Invention

According to the present invention, the transmission light amount adjusting unit for adjusting the transmission light amount so as to make the illuminance distribution on the irradiation target face uniform is constructed by providing the light transmission plate laminate member having the light transmission plates which are constant in transmittance in the wavelength range of light to be transmitted and whose number corresponds to the adjustment amount of the light transmission amount are stacked so that incident light is reflected at each boundary of the front and back sides of each light transmission plate. Therefore, the transmission light amount can be adjusted by merely changing the number of light transmission plates. Accordingly, the unevenness of illuminance on the irradiation target face can be reduced with such a simple stacked construction of light transmission plates without preparing for plural kinds of transmission type optical filters which are different in transmittance.

DESCRIPTION OF THE REFERENCE NUMERALS

FIG. 14 is a diagram showing the construction of a light diffusing member, wherein FIG. 14(A) is a longitudinally-sectional view showing the pseudo illuminating device together with an enlarged light diffusing member, and FIG. 14(B) is a diagram showing the light diffusing member when the light diffusing member is viewed from the irradiation target face side.

Figure 15:
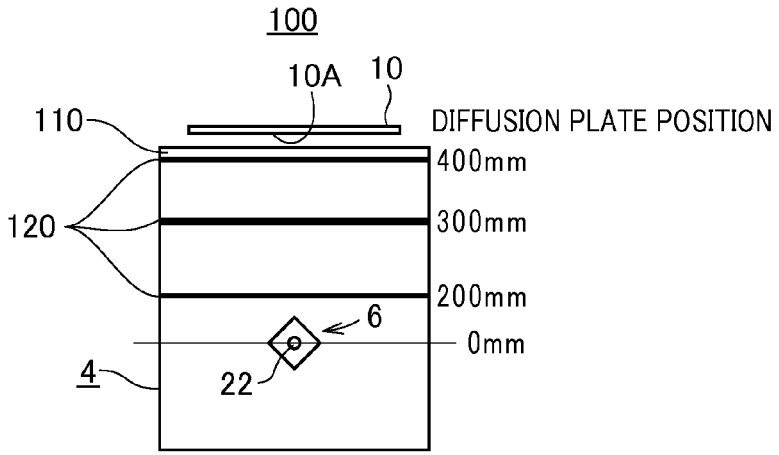

FIG. 15 is a diagram showing an experiment of measuring unevenness in illuminance while the light diffusion member is varied, wherein FIG. 15(A) is a diagram showing the arrangement position of the light diffusion member, FIG. 15(B) is a diagram showing the relationship of the position of the light diffusion member, the type of a diffusion plate used for the light diffusion member and measurement results of unevenness in illuminance, and FIG. 15(C) is a diagram showing the type of the diffusion plate used for the light diffusion member.

Figure 16:
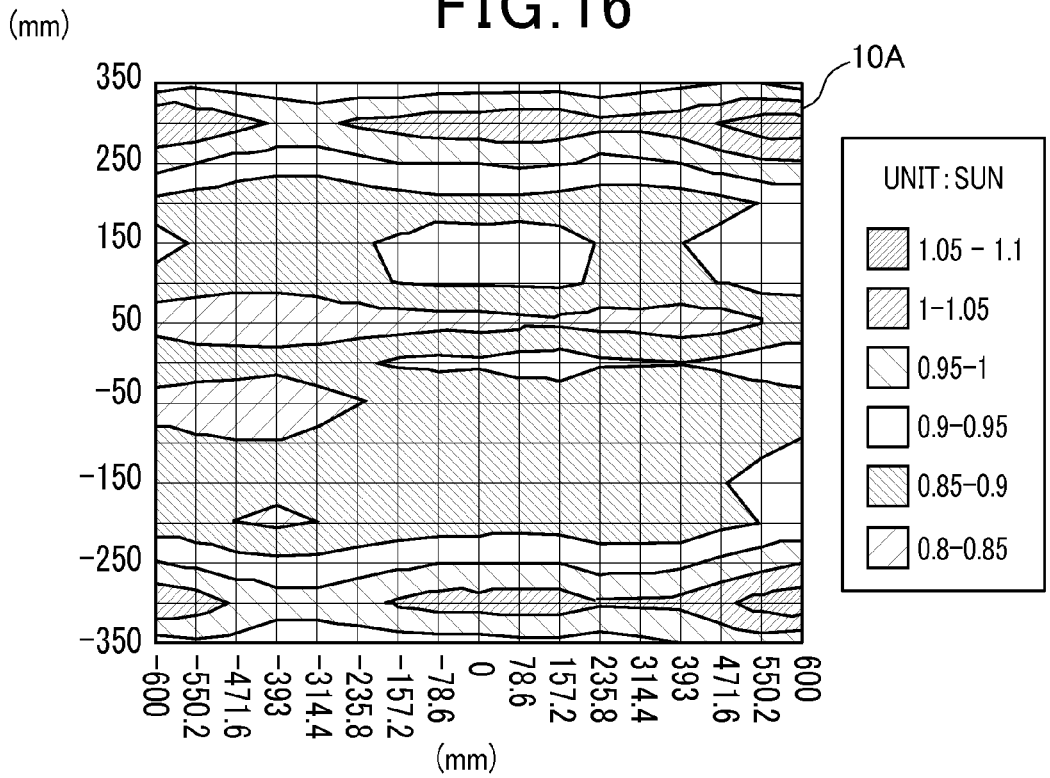
Figure 16:
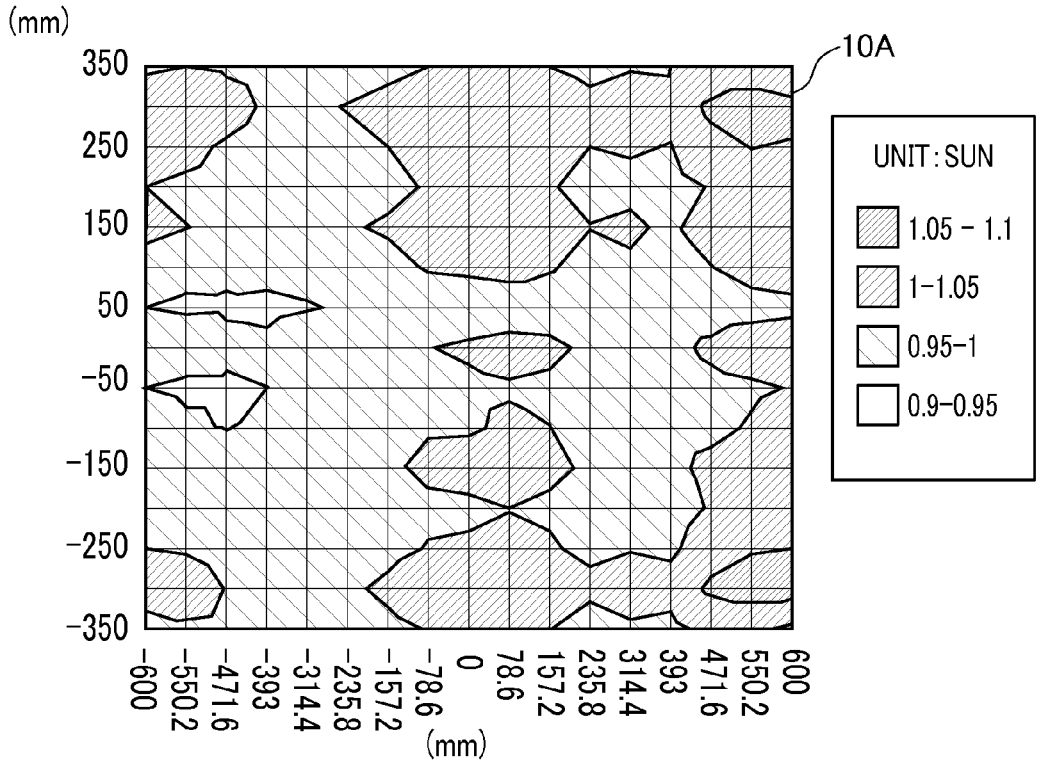

FIG. 16 is a diagram showing the measurement result of the illuminance distribution of the irradiation target face by the pseudo sunlight irradiating device in which no illuminance adjusting plate is disposed, wherein FIG. 16(A) is a diagram showing a measurement result of the illuminance distribution when light diffusion members of two layers are laminated and disposed at the irradiation target face, and FIG. 16(B) is a diagram showing a measurement result of the illuminance distribution when the light diffusion members of the two layers are disposed so as to be spaced from each other.

Figure 17:
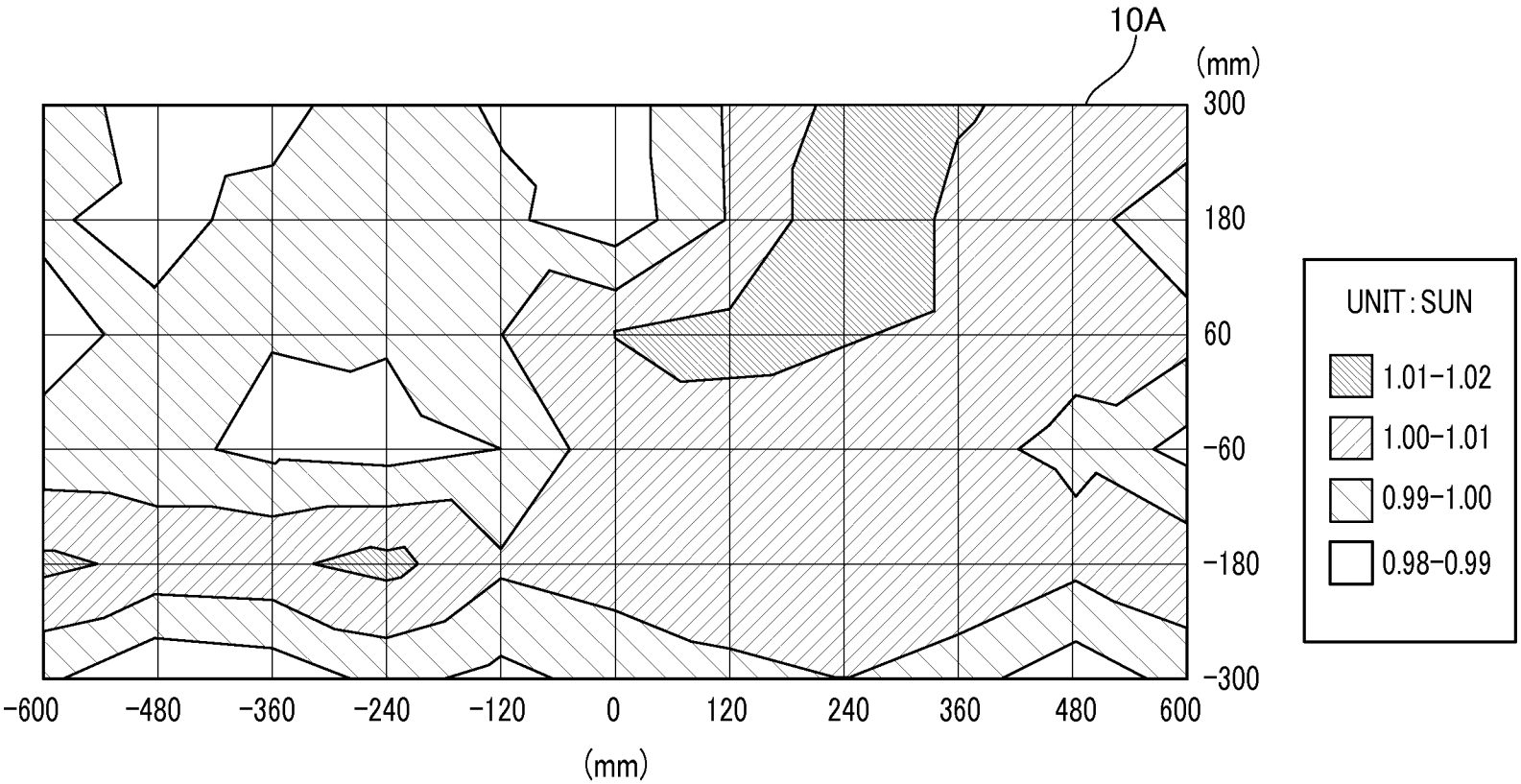

FIG. 17 is a diagram showing a measurement result of unevenness in illuminance of a pseudo sunlight irradiating device in which an illuminance adjusting plate is disposed.

MODES FOR CARRYING OUT THE INVENTION

Embodiments of the present invention will be described hereunder with reference to the drawings. In the following embodiments, a pseudo sunlight irradiating device will be described as an example of the illuminating device according to the present invention.

<First Embodiment>

Figure 1:
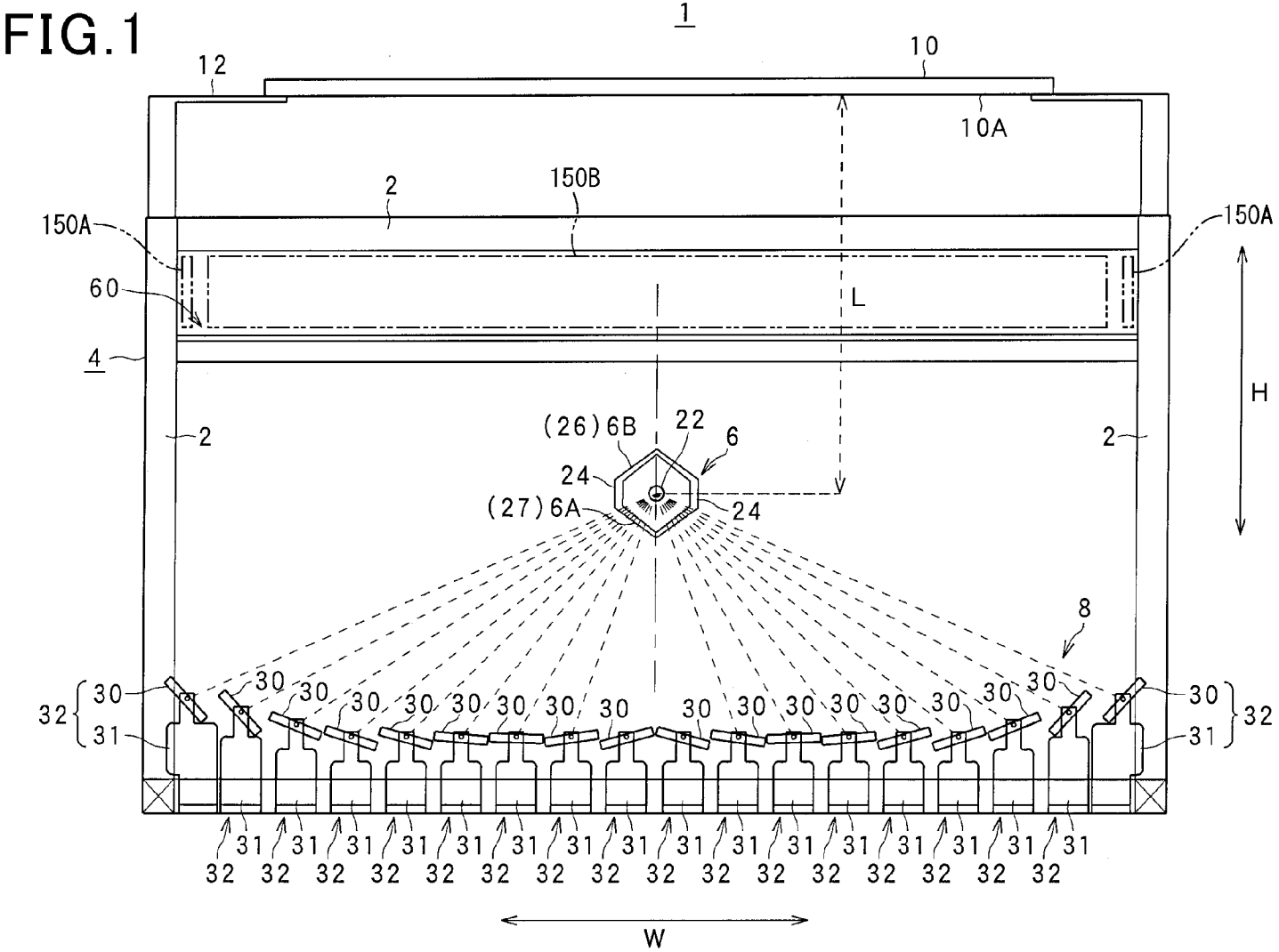
FIG. 1 is a longitudinally-sectional view showing the construction of a pseudo sunlight irradiating device according to a first embodiment of the present invention.

FIG. 1 is a longitudinally-sectional view showing the construction of a pseudo sunlight irradiating device 1 according to a first embodiment. In FIG. 1, W represents the width direction, and H represents the height direction. The pseudo sunlight irradiating device 1 has a frame body 4 formed by assembling plural square bars in a grid-like form, and the frame body 4 is designed in a dimension of about 2 m (meter) in length and about 1.2 to 1.3 m in width and height. Each of the four side surfaces of the frame body 4 are covered by light shielding plates (not shown) for preventing invasion of external light into the frame body 4.

In the pseudo sunlight irradiating device 1, a pseudo sunlight irradiating box 6 for emitting pseudo sunlight is bridged between side surfaces confronting each other in the length direction of the frame body 4. Furthermore, a reflection face 8 is disposed so as to confront a lower face 6A of the pseudo sunlight irradiating box 6, and an irradiation target body 10 having a flat irradiation target face 10A such as a solar battery panel or the like is disposed so as to confront an upper face 6B, whereby the whole area of the irradiation target face 10A is illuminated with direct light from the pseudo sunlight irradiating box 6 and reflection light from the reflection face 8. The irradiation target face 10A covers the upper surface of the frame body 4, thereby preventing invasion of external light from the upper surface concerned.

Figure 2:
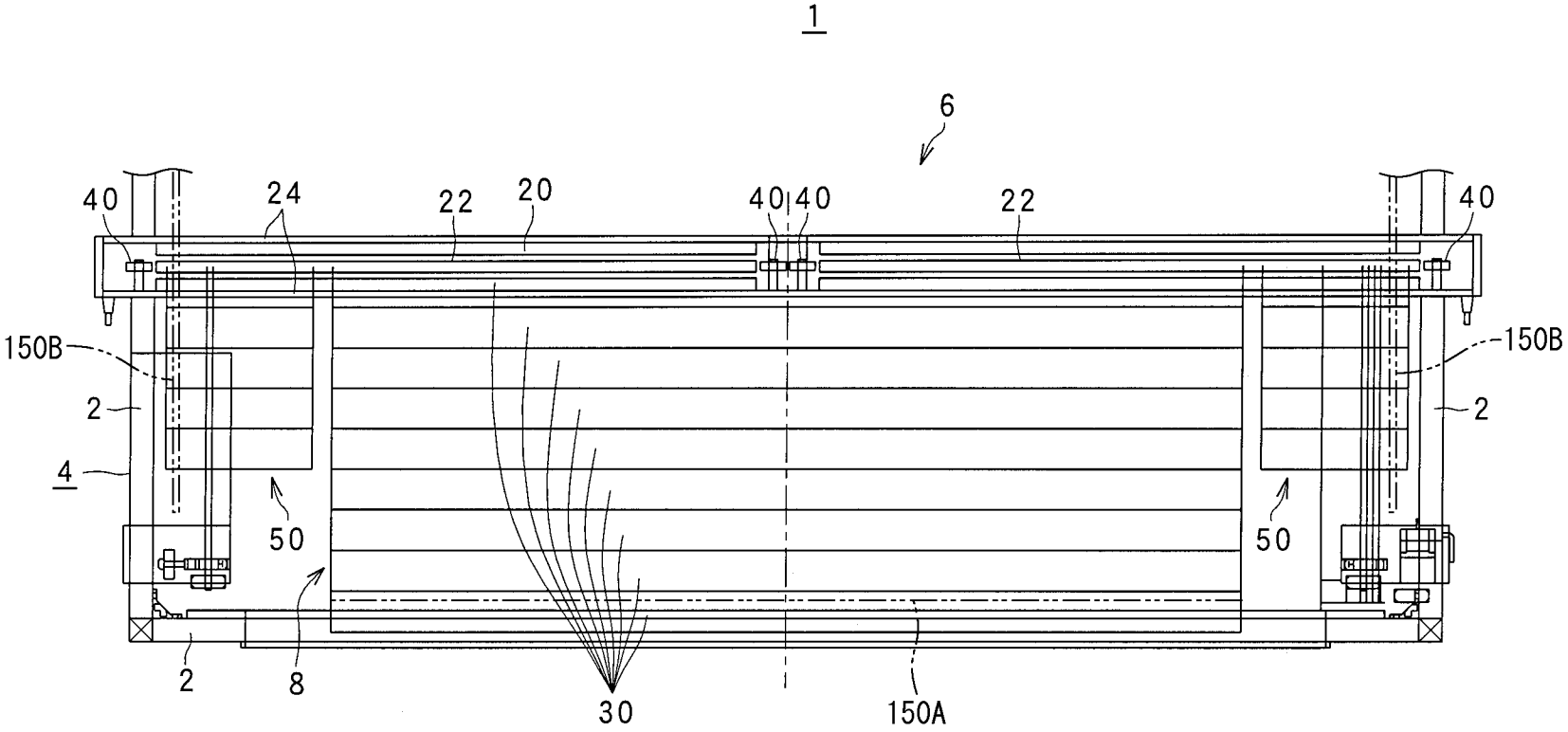
FIG. 2 is a plan view showing the right half side of a pseudo sunlight irradiating device.
Figure 3:
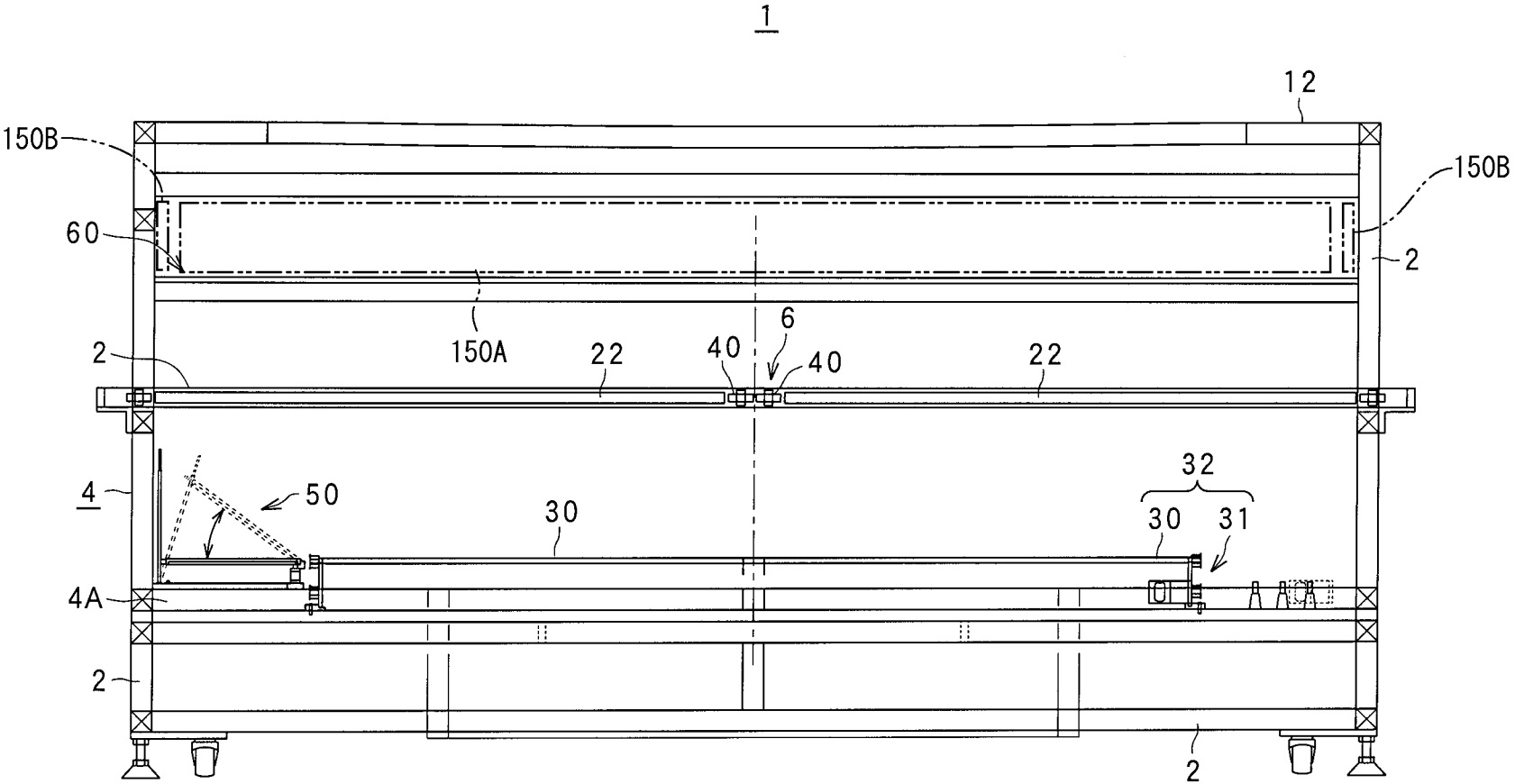
FIG. 3 is a cross-sectional view showing the construction of the pseudo sunlight irradiating device.

FIG. 2 is a plan view showing the right half side of the pseudo sunlight irradiating device 1, and FIG. 3 is a cross-sectional view showing the construction of the pseudo sunlight irradiating device 1.

As shown in FIGS. 2 and 3, two straight pipe type lamps (light sources) 22 are concentrically disposed along the pseudo sunlight irradiating box 6 to form a linear light source in the pseudo sunlight irradiating box 6. For example, xenon flash tubes or the like which have strong continuous spectra over a broad wavelength region from an ultraviolet region through a visible region to an infrared region. Terminal tables 40 are disposed at both the end portions of the lamps 22.

As shown in FIG. 1, the pseudo sunlight irradiating box 6 has a pair of elongated plate type side frames 24 constituting both the side surfaces along the longitudinal direction, an upper optical filter 26 constituting the upper face 6B, a lower optical filter 27 constituting the lower face 6A, and clasps (not shown) for fixedly assembling the side frames 24, the upper optical filter 26 and the lower optical filter 27. The side frames 24 are formed of light shielding members, or light shielding members for preventing transmission of light are added or coated onto the side frames 24.

Each of the upper optical filter 26 and the lower optical filter 27 is a so-called air mass filter for approximating an emission spectrum of emitted light from the lamp 22 to sunlight by cutting off an infrared region from the emitted light, and it is constructed by using a dielectric multilayer film. Furthermore, as shown in FIG. 1, each of the upper optical filter 26 and the lower optical filter 27 is constructed by fitting two plate-like filter members 26 in inversed V-shape (V-shape) so that the incident angle of incident light is approximated to be as vertical as possible and thus suppress the wavelength shift of transmitted light.

As shown in FIG. 1, the reflection face 8 is configured to have plural reflecting devices 32 which holds reflection plates 30 for reflecting pseudo sunlight from the lower face 6A of the pseudo sunlight irradiating box 6 and irradiating the irradiation target face 10A of the irradiation target body 10 with the pseudo sunlight while the reflection plates 30 can be freely tilted.

The irradiation target body 10 is mounted on a sample support frame 12 secured onto the frame body 4 so that the irradiation target face 10A is far away from the pseudo sunlight irradiating box 6 by a predetermined distance L, and the irradiation target face 10A is irradiated with direct light from the upper face 6B of the pseudo sunlight irradiating box 6 and reflection light reflected from the reflection face 8. Light distribution of the reflected light is controlled so as to compensate for unevenness of illuminance of the direct light on the irradiation target face 10*a*.

The reflection plates 30 have metal plate members on the surfaces thereof, and extend substantially in parallel to the pseudo sunlight irradiating box 6 as shown in FIGS. 2 and 3. The reflecting device 32 is constructed by the reflection plate 30 and a holding member 31 for holding the reflection plate 30.

The plural reflecting devices 32 are juxtaposed with one another on the bottom floor 4A of the frame body 4, whereby the bottom floor 4A is paved with the plural reflection plates 30, and the reflection face 8 is constructed by these reflection plates 30.

The holding member 31 has an angle adjusting mechanism for adjusting the tilt angle of the reflection plate 30, whereby the light reflection angle of each reflection plate 30 can be independently adjusted. At this time, some holding members 31 near to both the side surfaces in the width direction of the frame body 4 are configured to be successively increased in height as shown in FIG. 1, whereby the reflection light from the reflection plates 30 at both the side surface sides is prevented from being intercepted by the inside reflection plates 30.

As shown in FIGS. 2 and 3, auxiliary reflection faces 50 for reflecting light to both the end sides ion the length direction are provided at the confronting side surface sides in the length direction of the frame body 4. The auxiliary reflection face 50 are constructed by arranging plural plate members having metal surfaces which extend substantially in parallel along the pseudo sunlight irradiating box 6. This auxiliary reflection faces 50 are used to compensate for reduction of illuminance of direct light at both the end sides in the length direction of the pseudo sunlight irradiating box 6 by adjusting the reflection angles (tilt angles) of the auxiliary reflection faces 50 when the reduction of illuminance of direct light is remarkable, for example.

As shown in FIG. 1, a transmission light amount adjusting unit 60 is provided between the pseudo sunlight irradiating box 6 and the irradiation target face 10A so as to cover the whole surface of the irradiation target face 10A and adjust the amount of transmitted light so that the illuminance distribution on the irradiation target face 10A is made uniform.

That is, according to the pseudo sunlight irradiating device 1, not only the unevenness in illuminance of the direct light due to the reflection light of the reflection face 8 is compensated, but also the unevenness of illuminance of the irradiation target face 10A can be reduced by the transmission light amount adjusting unit 60.

Figure 4:
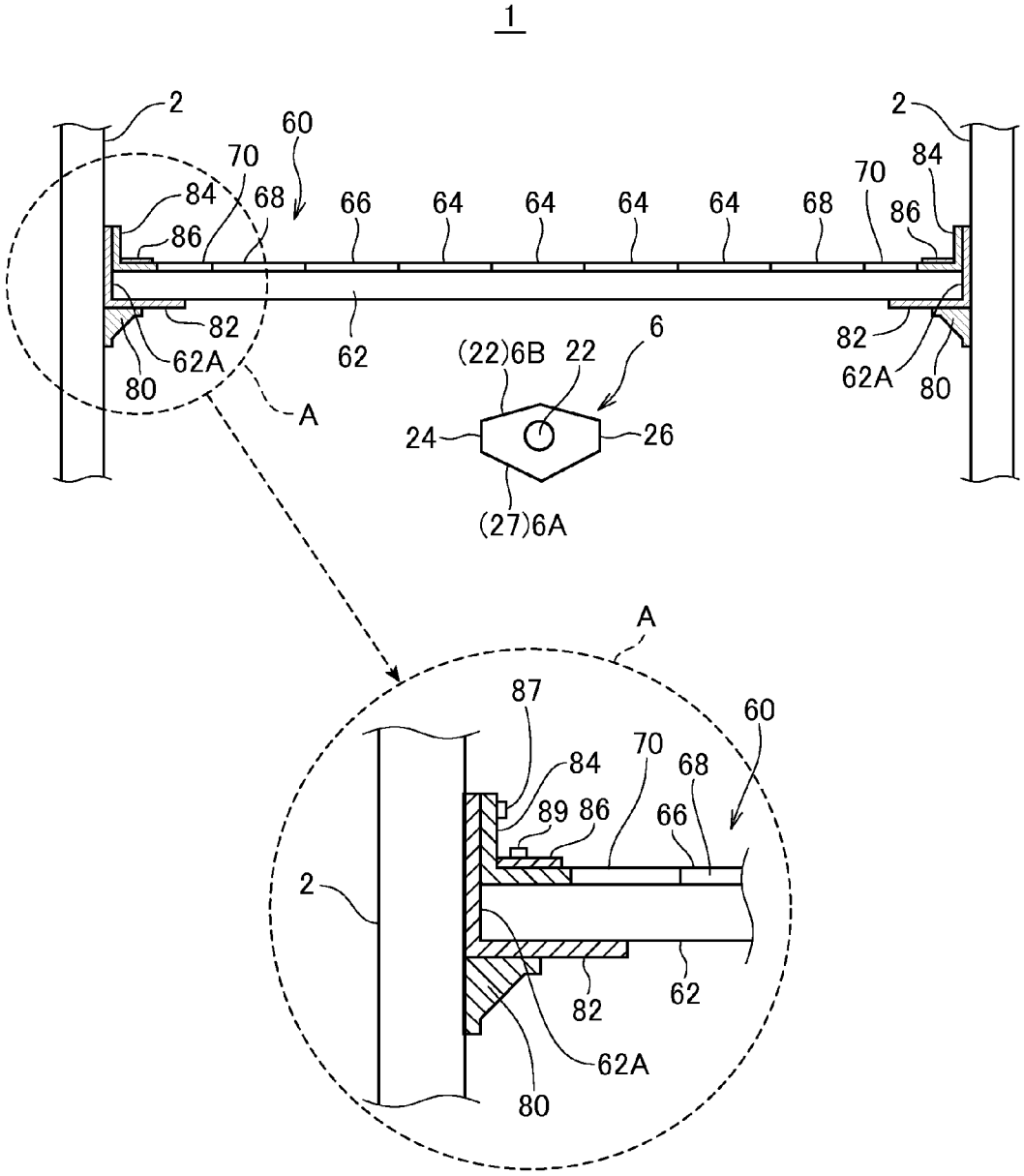
FIG. 4 is a longitudinally-sectional view showing the construction of a transmission light amount adjusting unit.
Figure 5:
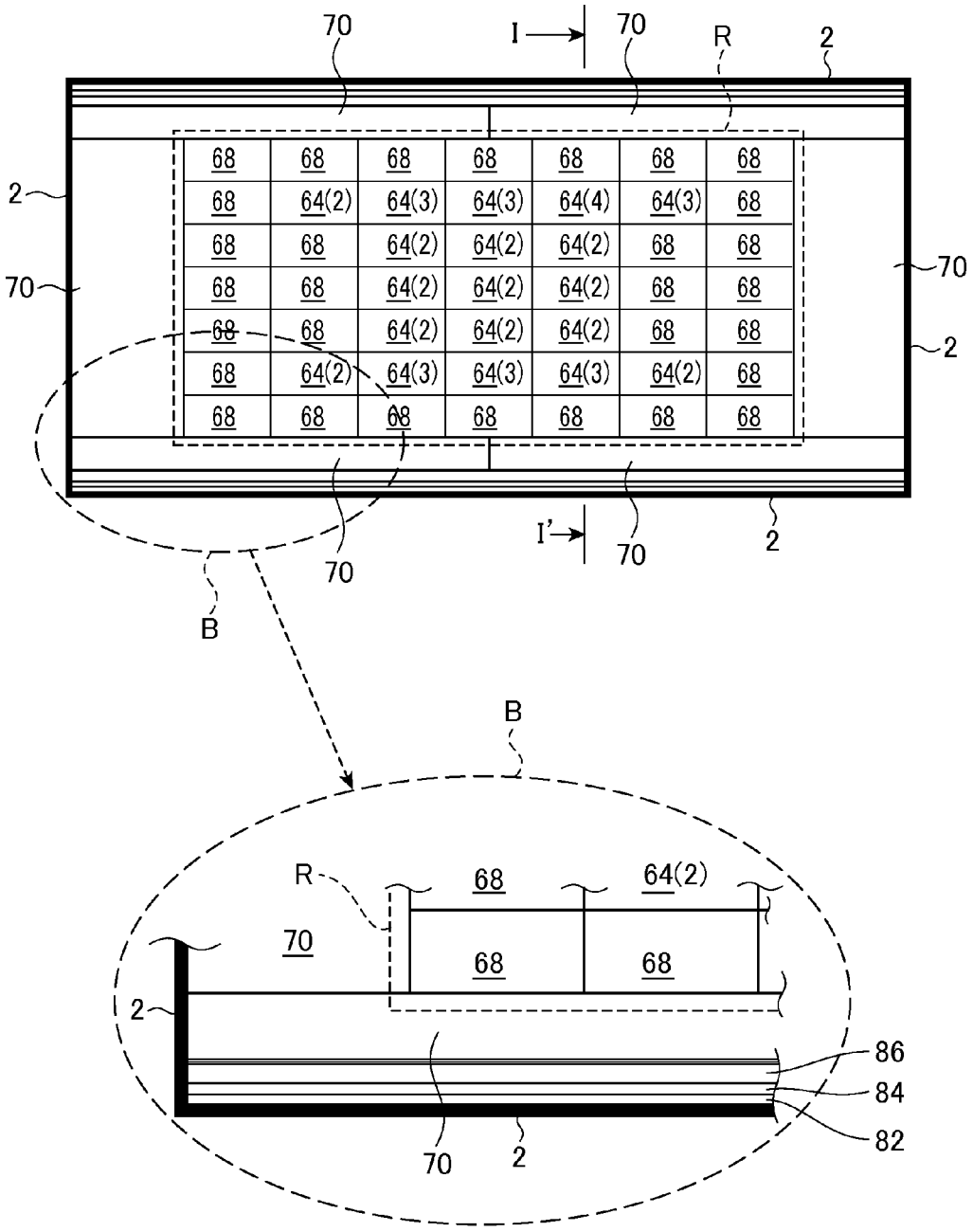
FIG. 5 is a plan view showing the construction of the transmission light amount adjusting unit.

FIG. 4 is a longitudinal sectional view showing the construction of the transmission light amount adjusting unit 60, and FIG. 5 is a plan view showing the construction of the transmission light amount adjusting unit 60.

As shown in FIG. 4, the transmission light amount adjusting unit 60 has a base plate 62, light transmission plate laminate members 64, and a surface film (press member) 66. The light amount of light traveling to a site of the irradiation target face 10 at which illuminance is high is reduced by the light transmission plate laminate members 64, whereby the illuminance distribution on the irradiation target face 10A is made uniform in conformity with low luminance.

Each of the base plate 62, the light transmission plate laminate members 64 and the surface film 66 is formed of a material which has a fixed transmittance (flat) in the spectral range of pseudo sunlight emitted from the pseudo sunlight irradiating box 6, and more preferably has high transmittance so that the spectrum of the pseudo sunlight is not modulated. According to this embodiment, acrylic resin is used as this material. Glass may be used as the material.

The base plate 62 is a plate-like member which has a rectangular shape in top view and carries the light transmission plate laminate members 64, and it is designed to have a thickness which makes the base plate 62 rigid to the extent that no deflection occurs due to its own weight. The base plate 62 concerned is disposed so as to perfectly insulate the pseudo sunlight irradiating box 6 and the irradiation target face 10A from each other.

As shown in FIG. 5, the light transmission plate laminate members 64 are disposed at respective positions where the transmission light amount should be reduced over an illumination light passing range R through which light illuminated to the irradiation target face 10A is passed. Furthermore, single light transmission plates 68 (hereinafter referred to as "spacer light transmission plate 68") formed of acrylic resin which is the same material as the light transmission plate laminate member 64, the light transmission plate 65 constituting the light transmission plate laminate member 6 and the base plate 62 are disposed at the remaining sites of the illumination light passing range R. Accordingly, the illumination light passing range R is paved with the light transmission plate laminate members 64 and the spacer light transmission plates 68 with no space thereamong. The spacer light transmission plate 68 is formed in the same dimension as the light transmission plate laminate member 64, and thus the spacer light transmission plate 68 and the light transmission plate laminate member 64 can be replaced by each other.

Figure 6:
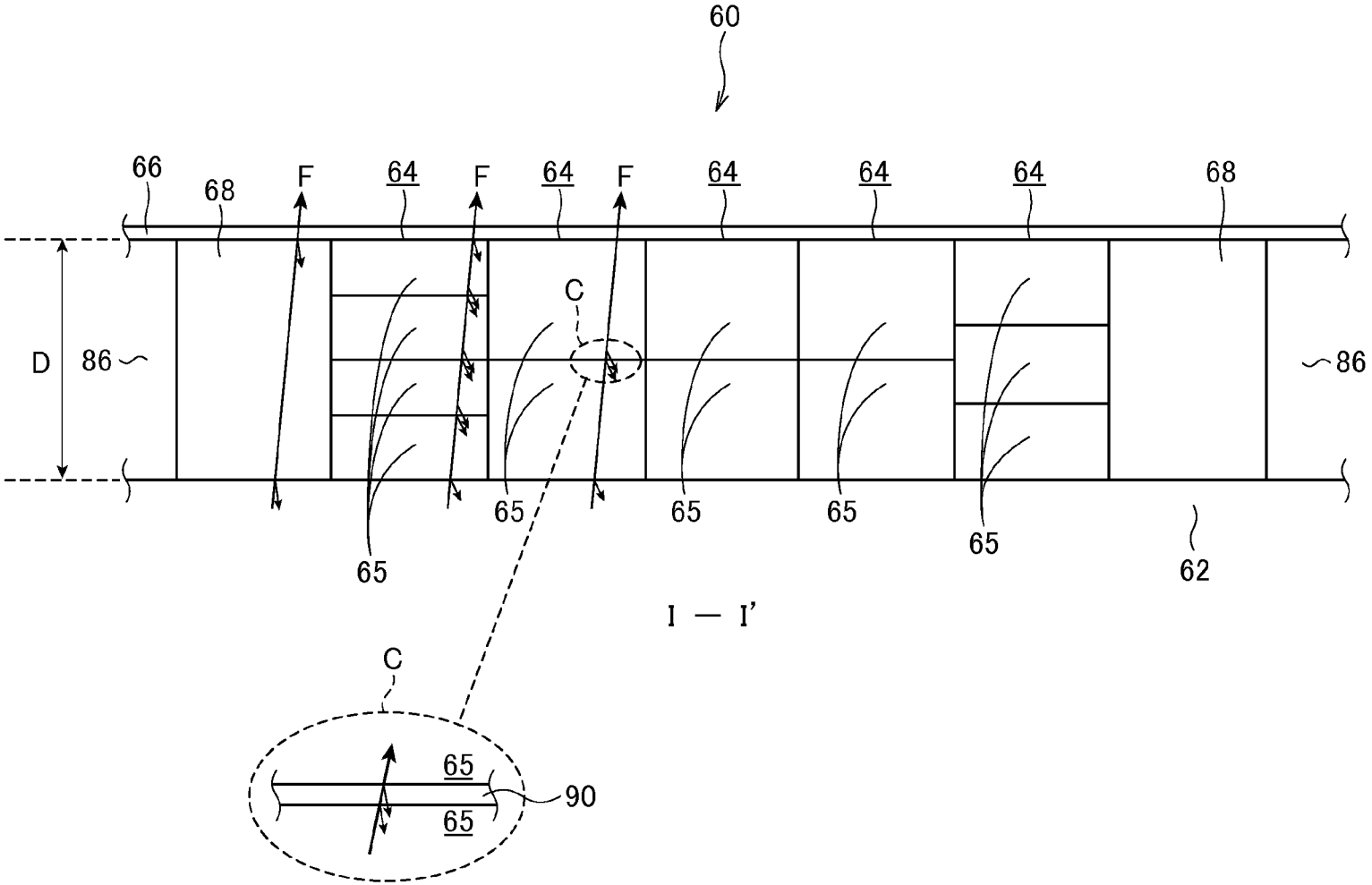
FIG. 6 is a diagram showing a section of I-I' line shown in FIG. 5.

The light transmission plate laminate member 64 is constructed by laminating plural light transmission plates 65 (FIG. 6). The number in each parenthesis affixed to reference numeral 64 in FIG. 5 represents the number of light transmission plates 65 of each light transmission plate laminate member 64. The specific construction of the light transmission plate laminate member 64 and the light amount adjusting action thereof will be described in detail later.

As shown in FIG. 5, a spacer plate (spacer member) 70 filled in the gap between the illumination light passing range R and the side surface of the pseudo sunlight irradiating device 1 is provided around the illumination light passing range R. That is, the upper surface of the base plate 62 is paved with the light transmission plate laminate members 64, the spacer light transmission plates 68 and the spacer plate 70 with no space, and thus the light transmission plate laminate members 64 can be positionally fixed without being adhesively attached to the base plate 62. Accordingly, the positional displacement of the light transmission plate laminate members 64 can be prevented even when some impact under installation or vibration under earthquake is applied to the transmission light amount adjusting unit 60 while the light transmission plate laminate members 64 can be freely exchanged.

It is preferable that the same material (acrylic resin in this embodiment) as the light transmission plate laminate members 64 is used as the material of the spacer plate 70. In this case, the optical characteristic of the spacer 70 is the same as the spacer light transmission plate 68 provided to the illumination light passing range R. Accordingly, even when the area of the irradiation target face 10A is increased and thus the illumination light passing range R expands somewhat to the surrounding, the whole area of the irradiation target face 10A can be illuminated.

As shown in FIG. 4, in order to prevent lateral displacement of the light transmission plates 65 of the light transmission plate laminate members 64 mounted on the base plate 62, the surface film 66 covers and presses the surfaces of the spacer light transmission plates 68 and the spacer plate 70 together with the light transmission plate laminate members 64. This surface film 66 is formed of thin film type PET (polyethylene terephthalate) material which does not modulate the spectrum of the pseudo sunlight as in the case of acrylic resin.

Next, a fixing structure of the transmission light amount adjusting unit 60 to the pseudo sunlight irradiating device 1 will be described.

In the pseudo sunlight irradiating device 1, slip-drop preventing brackets 80 extending in parallel to the pseudo sunlight irradiating box 6 are provided to both the side surfaces between which the pseudo sunlight irradiating box 6 is sandwiched as shown in FIG. 4. Furthermore, a fixing L angle 82 having an L-shape in section is fixed to each slip-drop preventing bracket 80, and both the edge portions 62A of the base plate 62 of the transmission light amount adjusting unit 60 are mounted on the respective fixing L angles 82, whereby the base plate 62 is mounted.

Lateral displacement preventing L angles 84 which is filled in the gap between the spacer plate 70 and the side surface of the pseudo sunlight irradiating device 1 to prevent lateral displacement of the spacer plate 70 are provided to the upper surfaces of both the edge portions 62A of the base plate 62.

When the transmission light amount adjusting unit 60 is secured, the fixing L angles 82 are first fixed to the square bars 2 by screws. The base plate 62 is mounted on the fixing L angles 82, the lateral displacement preventing angles 84 are mounted on the base plate 62 from the upper side, and then the preventing L angles 84 are fixed to the fixing L angles 82 and the square bars of the side surfaces of the pseudo sunlight irradiating device 1 by screws 87. Accordingly, the edge portions 62A of the base plate 62 are sandwiched by the fixing L angles 82 and the lateral displacement preventing angles 84, thereby preventing the base plate 62 from jouncing.

Subsequently, the spacer plate 70, the light transmission plate laminate members 64 and the spacer light transmission plates 68 are paved on the base plate 62. Then, the spacer plate 70, the light transmission plate laminate members 64 and the spacer light transmission plates 68 are covered by the surface film 66 together with the lateral displacement preventing L angles 84. Finally, the edge portions of the surface film 66 are pressed by press bars 86, and the press bars 86 are fixed to the lateral displacement preventing L angles 84 by bolts 89. Through the above work, the fixing work of the transmission light amount adjusting unit is completed.

Next, the construction of the light transmission plate laminate member 64 will be described.

FIG. 6 is a diagram showing the section taken along I-I' in FIG. 5.

As shown in FIG. 6, each light transmission plate laminate member 64 is constructed by plural light transmission plates 65 formed of acrylic resin whose light transmission faces are rectangular and equal in dimension. When pseudo sunlight F is incident to each light transmission plate laminate member 64, reverse reflection of the pseudo sunlight F occurs at the boundaries of the front and back surfaces of each light transmission plates 65, and the amount of light transmitted through the light transmission plate laminate member 64 is reduced by the amount corresponding to the reverse reflection. Furthermore, the transmittance of the light transmission plate laminate member 64 is not dependent on the thickness of the light transmission plate 65, but determined by the number of stacked light transmission plates 65. The transmission characteristic of the light transmission plate laminate member 64 as described above will be described below.

Figure 7:
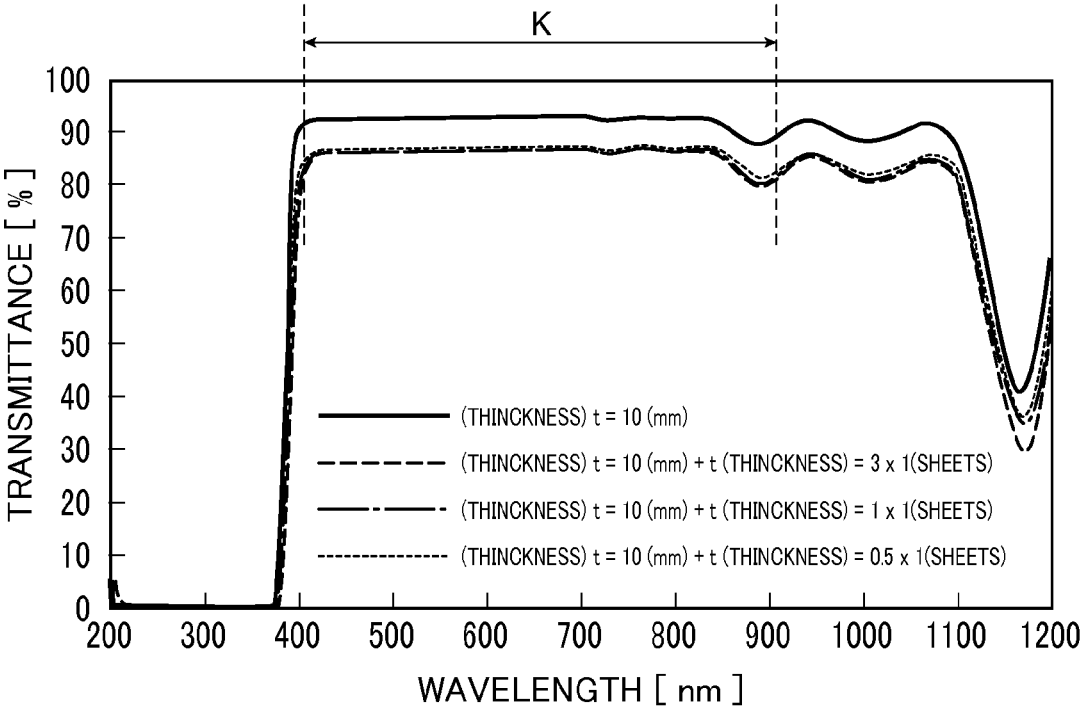
FIG. 7 is a diagram showing the relationship between the thickness of a light transmitting plate formed of acrylic resin and the transmission characteristic thereof.
Figure 8:
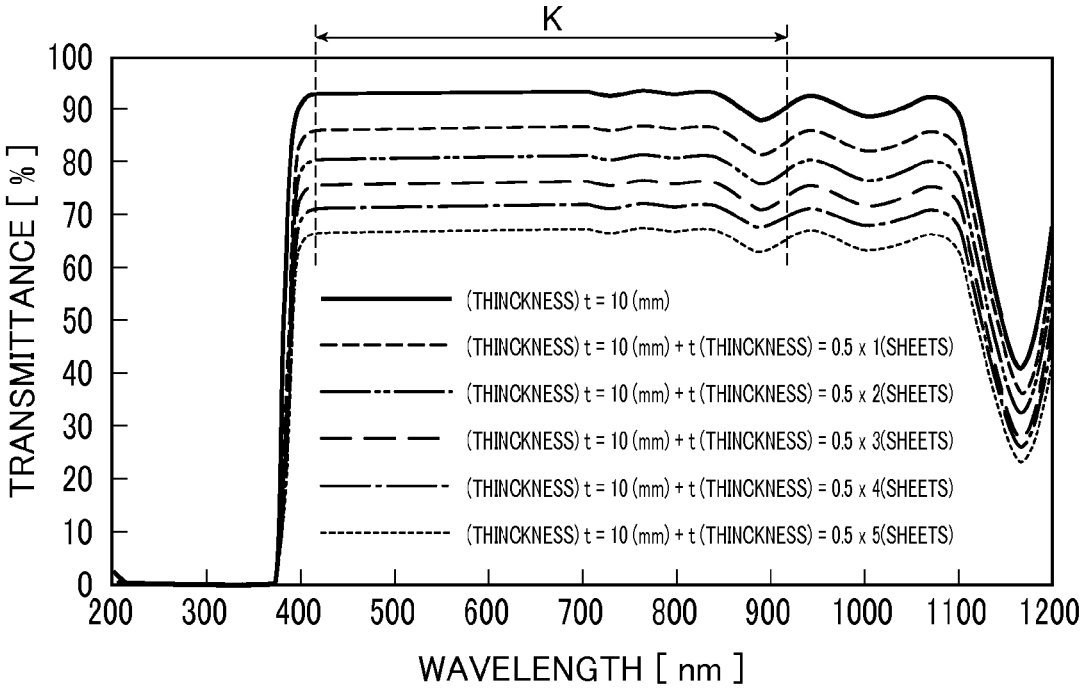
FIG. 8 is a diagram showing the relationship between the number of light transmitting plates formed of acrylic resin and the transmission characteristic thereof.
Figure 9:
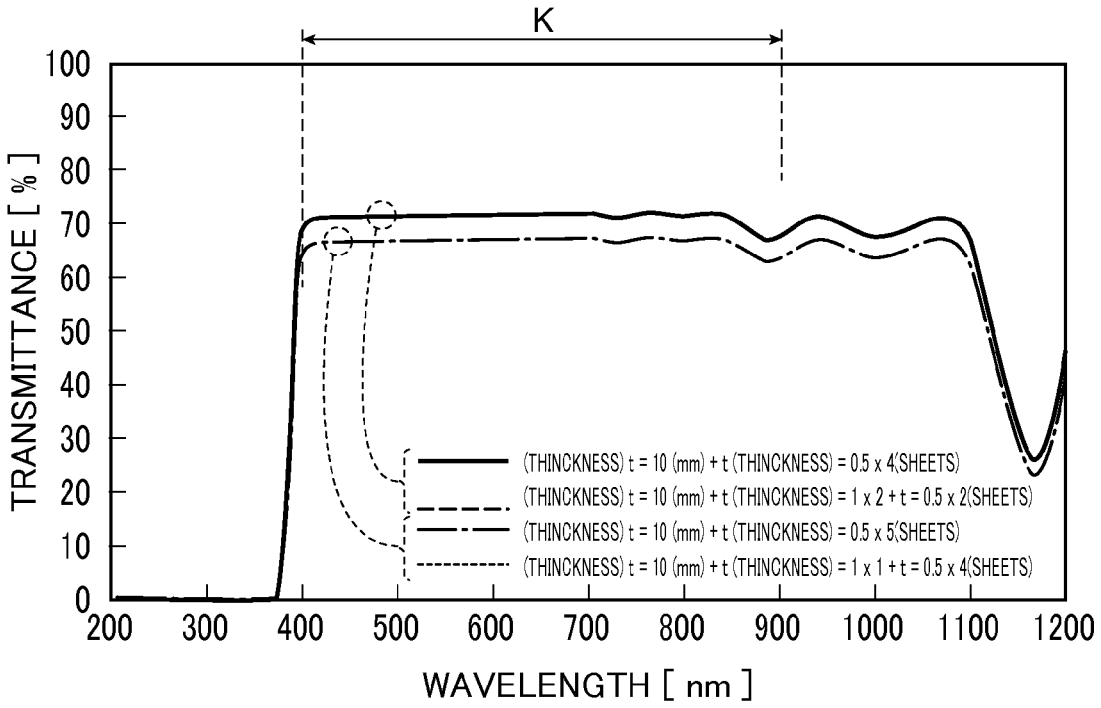
FIG. 9 is a diagram showing the variation of the transmission characteristic when the thickness of the light transmission plate formed of acrylic resin and the number of the transmission plates are varied while the thickness of a light transmission plate laminate member is fixed.

FIG. 7 is a diagram showing the relationship between the thickness t of the light transmission plate 65 formed of acrylic resin and the transmission characteristic thereof, and FIG. 8 shows the relationship between the number of light transmission plates 65 and the transmission characteristic. Furthermore, FIG. 9 is a diagram showing the variation of the transmission characteristic when the thickness of the light transmission plate laminate member 64 is fixed and the thickness t and the number of the light transmission plates 65 are varied.

As shown in these figures, it is apparent that the light transmission plate 65 has a transmission characteristic that the transmittance is substantially fixed (flat) over a broad wavelength range from the ultraviolet region (wavelength 400 nm) to the infrared region (wavelength 900 nm) used as pseudo sunlight F, and it has high transmittance. Accordingly, according to the light transmission plate 65 and the spacer light transmission plate 68, the spacer plate 70 and the base plate 62 which are formed of the same material as the light transmission plate 65, the pseudo sunlight F emitted from the pseudo sunlight irradiating box 6 can be transmitted with high efficiency without modulating the spectrum thereof, and thus the reduction of the illumination efficiency can be prevented.

At this time, as shown in FIG. 7, when the base plate 62 is formed of acrylic resin and designed to have a thickness of 10 mm and a single light transmission plate 65 is stacked on the base plate 62, the transmittance little varies even when the thickness t of the light transmission plate 65 increases to 0.5 mm, 1 mm, 3 mm.

On the other hand, as shown in FIG. 8, when the number of light transmission plates to be stacked on the base plate 62 of 10 mm thickness is increased one by one, the transmittance decreases substantially uniformly over the whole wavelength region in proportion to the number of the light transmission plates 65.

The following may be considered as a reason for this. Since acrylic resin as the material of the light transmission plate 65 has high transmittance to the pseudo sunlight F, absorption of pseudo sunlight F through the light transmission plate 65 occurs little when the pseudo sunlight F passes through the light transmission plate 65, however, reverse reflection occurs at each boundary of the front and back surfaces of the light transmission plate 65, so that the amount of the transmitted light is reduced due to each reverse reflection. The reasonability of this reason is backed up by the fact that the transmittance is substantially coincident in spite of the difference in thickness of the light transmission plates 65 between a case where four light transmission plates 65 of 0.5 mm thickness are stacked and a case where two light transmission plates 65 of 0.5 mm thickness are stacked on two light transmission plates 65 of 1 mm thickness, and the same result is obtained even when the number is changed to five.

Accordingly, in the transmission light amount adjusting unit 60 shown in FIG. 6, in the case of the light transmission plate laminate member 64 having two stacked light transmission plates 65, the reverse reflection occurs at the boundaries of the front and back sides of each light transmission plate 65, and thus the transmission light amount of the pseudo sunlight F is reduced by the amount corresponding to totally four reverse reflections. Furthermore, in the case of the light transmission plate laminate member 64 having four stacked light transmission plates 65, the transmission light amount is reduced by the amount corresponding to totally eight reverse reflections. As described above, in the light transmission plate laminate member 64, the reverse reflection frequency increases in proportion to the number of light transmission plates 65, and thus the transmission light amount of the pseudo sunlight F is reduced in proportion to the number of light transmission plates 65.

Here, as shown in FIG. 6, the following is a reason why reverse reflection occurs twice at the contact portion C between vertically stacked light transmission plates 65. That is, when the light transmission plates 65 are merely stacked without using any binder such as adhesive agent or the like, a thin air layer 90 is formed between these light transmission plates 65. The air layer 90 is interposed between the light transmission plates 65, whereby reverse reflection occurs when the pseudo sunlight F goes out from the lower light transmission plate 65 to the air layer 90 and also reverse reflection also occurs when the pseudo sunlight F goes from the air layer 90 into the upper light transmission plate 65. Accordingly, the reverse reflection occurs twice at the contact portion C.

As described above, the light transmission plates 65 are simply stacked without using any binder such as adhesive agent or the like, and only the air layer 90 is formed between the light transmission plates 65, whereby the transmittance of the light transmission plate laminate member 64 can be reduced in proportion to the laminate number of the light transmission plates 65, thereby obtaining the light transmission plate laminate member 64 in which the transmission light amount can be easily adjusted.

In the transmission light amount adjusting unit 60, the base plate 62 is provided below the light transmission plate laminate member 64 and the surface film 66 is provided on the light transmission plate laminate member 64. In addition, the spacer light transmission plate 68 is disposed at a site at which no light transmission plate laminate member 64 is disposed. Therefore, reverse reflection likewise occurs at each boundary of the base plate 62, the surface film 66 and the spacer light transmission plate 68. Accordingly, the number of the light transmission plates 65 of the light transmission plate laminate member 64 is determined in consideration of these reverse reflections.

Here, the light transmission plates 53 are simply laminated without using any binder such as adhesive agent or the like to constitute the light transmission plate laminate member 64, and thus the light transmission plates 65 are liable to be laterally displaced by an impact such as earthquake or the like. Therefore, as shown in FIG. 6, the thickness of the single light transmission plate 65 per plate is reduced in accordance with the number of light transmission plates 65 to be stacked, whereby the overall thickness D is set to a fixed value (3mm in this embodiment) irrespective of the number of stacked light transmission plates 65. Furthermore, the spacer light transmission plate 68 is also designed to have the same thickness D. Accordingly, another light transmission plate 65 or a spacer light transmission plate 68 necessarily exists at both the sides of a light transmission plate 65, and thus the lateral displacement of the light transmission plate 65 is prevented.

Furthermore, in the light transmission plate laminate member 64, the light transmission plates 65 are thinner as the number of light transmission plates 65 to be stacked increases. Therefore, lateral displacement is liable to occur in the light transmission plates 65 even when there is merely some dispersion in thickness among the light transmission plate laminate members 64 and the spacer light transmission plates 68. Therefore, according to this embodiment, as shown in FIG. 6, the surfaces of the light transmission plate laminate members 64 and the spacer light transmission plates 68 are covered by the surface film 66 so that the surfaces of the light transmission plate laminate members 64 are pressed by the surface film 66, whereby the lateral displacement of the light transmission plates 65 can be surely prevented.

Figure 10:
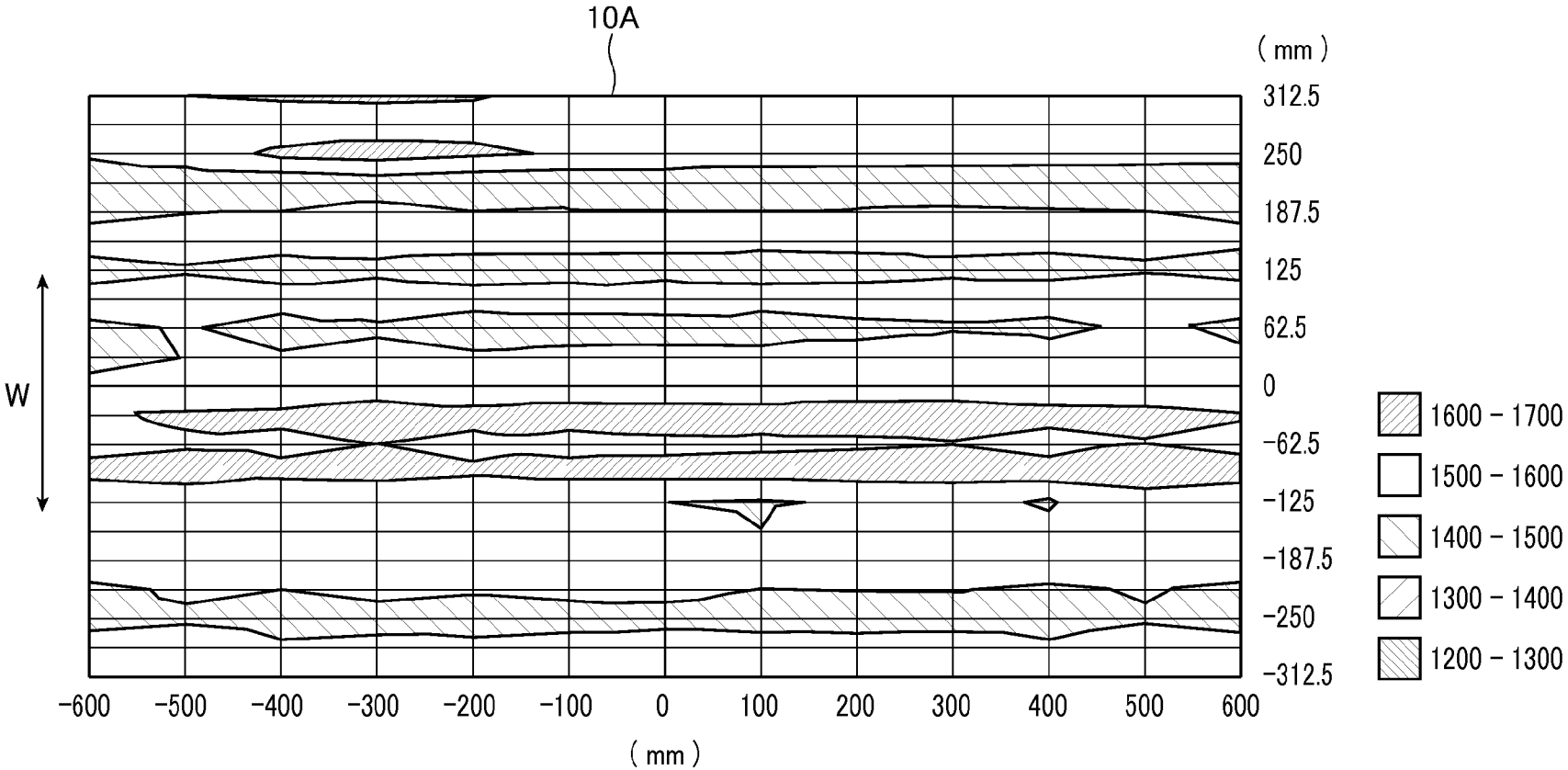
FIG. 10 is a diagram showing a measurement result of an illuminance distribution of an irradiation target face.

FIG. 10 shows a measurement result of unevenness of illuminance on the irradiation target face 10A by the pseudo sunlight irradiating device 1. When the unevenness of illuminance is calculated on the basis of the illuminance distribution shown in FIG. 10, a value of about 1.59% is obtained, and thus it has been demonstrated that the unevenness of illuminance of the irradiation target face 10A is excellently reduced according to the pseudo sunlight irradiating device f1 of this embodiment. This calculation of the unevenness of illuminance is performed on the basis of JIS C8912, JIS C8933 defined in JIS standards (Japanese Industrial Standards).

As described above, according to this embodiment, the transmission light amount adjusting unit 60 for adjusting the transmission light amount so that the illuminance distribution on the irradiation target face 10A is made uniform is constructed by providing the light transmission plate laminate members 64 each of which is obtained by stacking light transmission plates 65 whose transmittance is constant over the wavelength range K of the pseudo sunlight F and whose stack number corresponds to the adjustment amount of the transmission light amount so that incident light is reflected at each boundary of the front and back surfaces of each light transmission plate 65. According to this construction, the transmission light amount can be adjusted by merely changing the number of the light transmission plates 65, and the unevenness of illuminance on the irradiation target face 10A can be reduced without preparing for plural kinds of transmission type optical filter plates different in transmittance by a simple construction that the light transmission plates 65 are stacked.

Furthermore, according to this embodiment, the light transmission plate laminate plates 64 in which the thickness of each light transmission plate 65 is reduced in accordance with the stack number of light transmission plates 65 so that the light transmission plate laminate plates 64 are fixed in thickness are arranged at positions where the transmission light amount should be adjusted, the spacer light transmission plates are disposed in the gaps occurring between the light transmission laminate members 64, the illumination light passing range R is paved with the light transmission plate laminate members 64 and the spacer light transmission plates 68, and also the spacer plate 70 is disposed around the illumination light passing rage R, whereby the positional displacement of the light transmission plate laminate members 64 and the spacer light transmission plates 68 is prevented.

According to this construction, it is unnecessary that the base plate 62, the light transmission plate laminate members 64 and the spacer light transmission plates 68 are fixed by binder such as adhesive agent or the like. Therefore, the light transmission plate laminate member 64 and the spacer light transmission plate 68 can be freely exchanged by each other, and also the positional displacement of the light transmission plate laminate member 64 can be prevented even when an impact under installation or vibration under earthquake is applied to the transmission light amount adjusting unit 60.

Furthermore, according to this embodiment, the surface film 66 as the press member which covers and presses the surface of each of the light transmission plate laminate member 64 and the spacer light transmission plates 68 is provided.

According to this construction, the surface film 66 presses the surface of the light transmission plate laminate member 64, and the lateral displacement of the light transmission plates 65 can be surely prevented.

In this embodiment, the auxiliary reflection faces 50 are provided at the lower portions of the confronting side surface sides in the length direction of the frame body 4, however, auxiliary reflection faces 150A and 150B for reflecting, to the irradiation target face 10A, light emitted from the pseudo sunlight irradiating box 6 to the side surfaces of the frame body 4 may be provided between the lamp 22 of the side surface of the frame body 4 and the irradiation target face 10A as indicated by a two-dotted chain line in FIGS. 1 to 3. When the illuminance of direct light at the side surface sides of the frame body 4 decreases, the auxiliary reflection faces 150A, 150B are usable to compensate for the decrease of the illuminance of the direct light by adjusting the reflection angles (tilt angles) of the auxiliary reflection faces 50. The auxiliary reflection faces 150A, 150B are designed to have such lengths that no gap occurs at the adjusted tilt angles so that the illuminance at the four corners of the irradiation target face 10A is not reduced.

As described above, the auxiliary reflection faces 150A, 150B are disposed between the lamp 22 of the side surface of the pseudo sunlight irradiating device 1 and the irradiation target face 10A so that light which is a part of light irradiated from the lamp 22 and travels to sites out of the irradiation target face 10A is reflected to the irradiation target face 10A. According to this construction, light which is shielded by the light shielding plates disposed at the side surfaces of the frame body 4 can be effectively used to compensate for the reduction in illuminance on the irradiation target face 10A, and also the pseudo sunlight irradiating device 1 can be more greatly miniaturized as compared with a case where the auxiliary reflection face is disposed below the frame body 4.

<Second Embodiment>

In the first embodiment, the transmission light amount adjusting unit 60 for adjusting the transmission light amount is provided between the lamp 22 and the irradiation target face 10A to reduce the unevenness of illuminance of the irradiation target face 10A. However, according to a second embodiment, a light diffusion unit 101 for diffusing light is provided in place of the transmission light amount adjusting unit 60.

Figure 11:
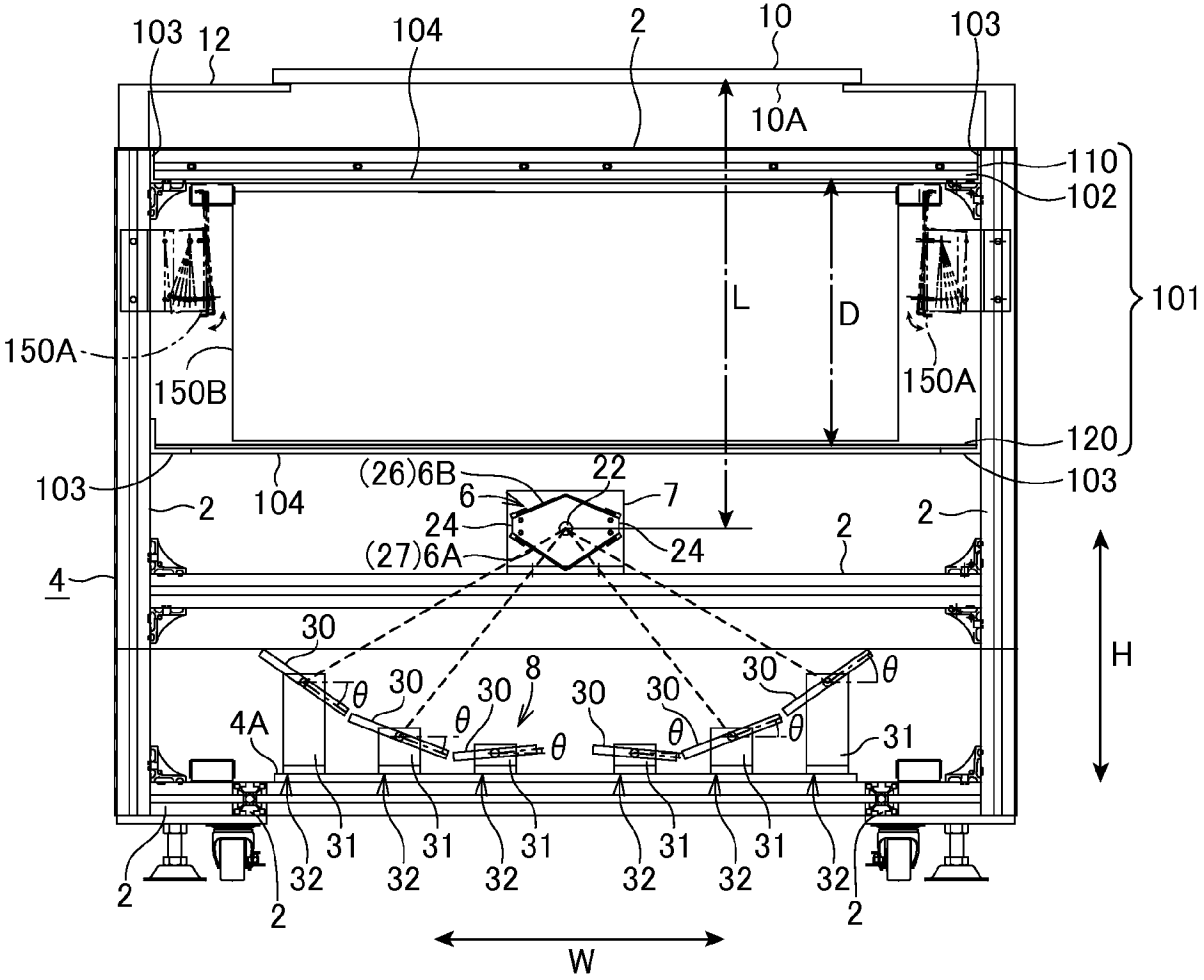
FIG. 11 is a longitudinal sectional view showing the construction of a pseudo sunlight irradiating device according to a second embodiment of the present invention.
Figure 12:
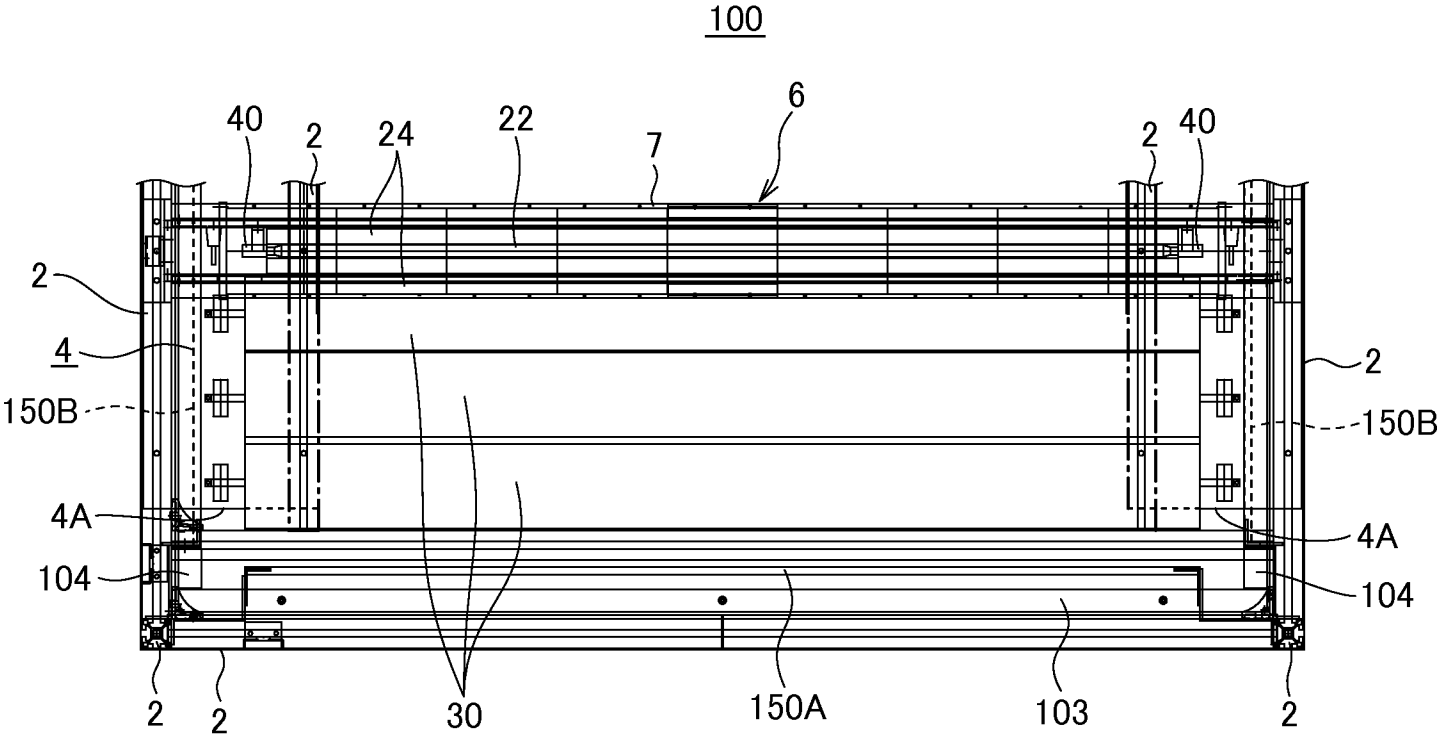
FIG. 12 is a plan view showing the right half side of the pseudo sunlight irradiating device.
Figure 13:
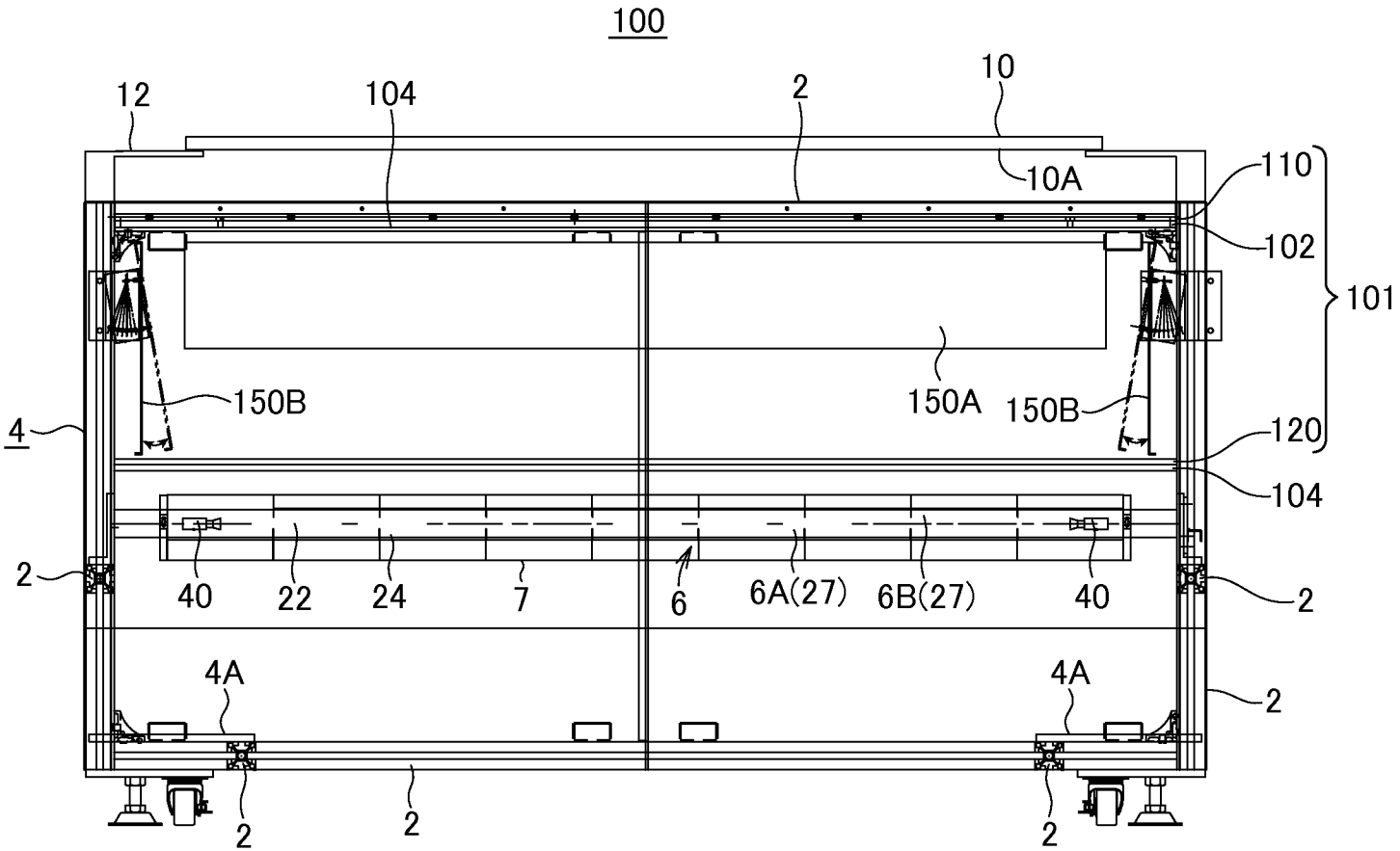
FIG. 13 is a cross-sectional view showing the construction of the pseudo sunlight irradiating device.

FIG. 11 is a longitudinal sectional view showing the construction of a pseudo sunlight irradiating device 100 according to a second embodiment. Furthermore, FIG. 12 is a plan view showing the right half portion of the pseudo sunlight irradiating device 100, and FIG. 13 is a cross-sectional view showing the construction of the pseudo sunlight irradiating device 100. In FIGS. 11 to 13, the same parts as the pseudo sunlight irradiating device 1 shown in FIGS. 1 to 3 are represented by the same reference numerals, and the description thereof is omitted.

In the pseudo sunlight irradiating device 100, the frame body 4 obtained by assembling plural square bars in a grid-like form is configured a dimension of about 1.7 mm in length, about 1.2 m in width and about 0.8 m in height, and the effective area of the irradiation target face 10A is set to 600 mm×1200 mm. Furthermore, in the pseudo sunlight irradiating box 6, one straight pipe type lamp 22 is disposed along the pseudo sunlight irradiating box 6 to constitute a linear light source. The pseudo sunlight irradiating box 6 is mounted in a lamp house 7 formed of a material which does not modulate the spectrum of pseudo sunlight emitted from the pseudo sunlight irradiating box 6.

The reflection face 8 is configured to have six reflecting devices 32, and the tilt angle 8 of reflection plates 30 is successively set to 33°, 21°, −5°, 5°, −21° and −33° from the right side in this order as shown in FIG. 1. According to this construction, even when the tilt angle is minutely adjusted every 0.1°, it does not affect the unevenness of illuminance of the irradiation target face 10A, and thus the required for a shipping adjustment can be shortened.

It is preferable that the tilt angles of the auxiliary reflection faces 150A, 150B are set to about 0° to 5°. The auxiliary reflection faces 150A, 150B are configured to have such lengths that no gap occurs therebetween so that the illuminance at the four corners of the irradiation target face 10A is not lowered when the title angles are adjusted to about 0° to 5°. In this embodiment, the length of the auxiliary reflection face 150A at the longitudinal side is set to about 1400 mm, and the length of the auxiliary reflection face 150B at the short side is set to about 920 mm.

In the thus-constructed relatively small type pseudo sunlight irradiating device 100, the distance L from the lamp 22 to the irradiation target face 10A is set to several tens cm, and thus it is difficult to make the unevenness of illuminance uniform. In addition, much labor is required to keep the uniform illuminance.

Therefore, according to this embodiment, a light diffusion unit 101 which covers the whole surface of the irradiation target face 10A and diffuses light so that the illuminance distribution on the irradiation target face 10A is made uniform is provided between the pseudo sunlight irradiating box 6 and the irradiation target face 10A. That is, according to the pseudo sunlight irradiating device 100, in addition to the compensation for the unevenness of illuminance of direct light by the reflection light from the reflection face 8, the unevenness of illuminance of the irradiation target face 10*a* can be also reduced by the light diffusion unit 101.

Figure 14:
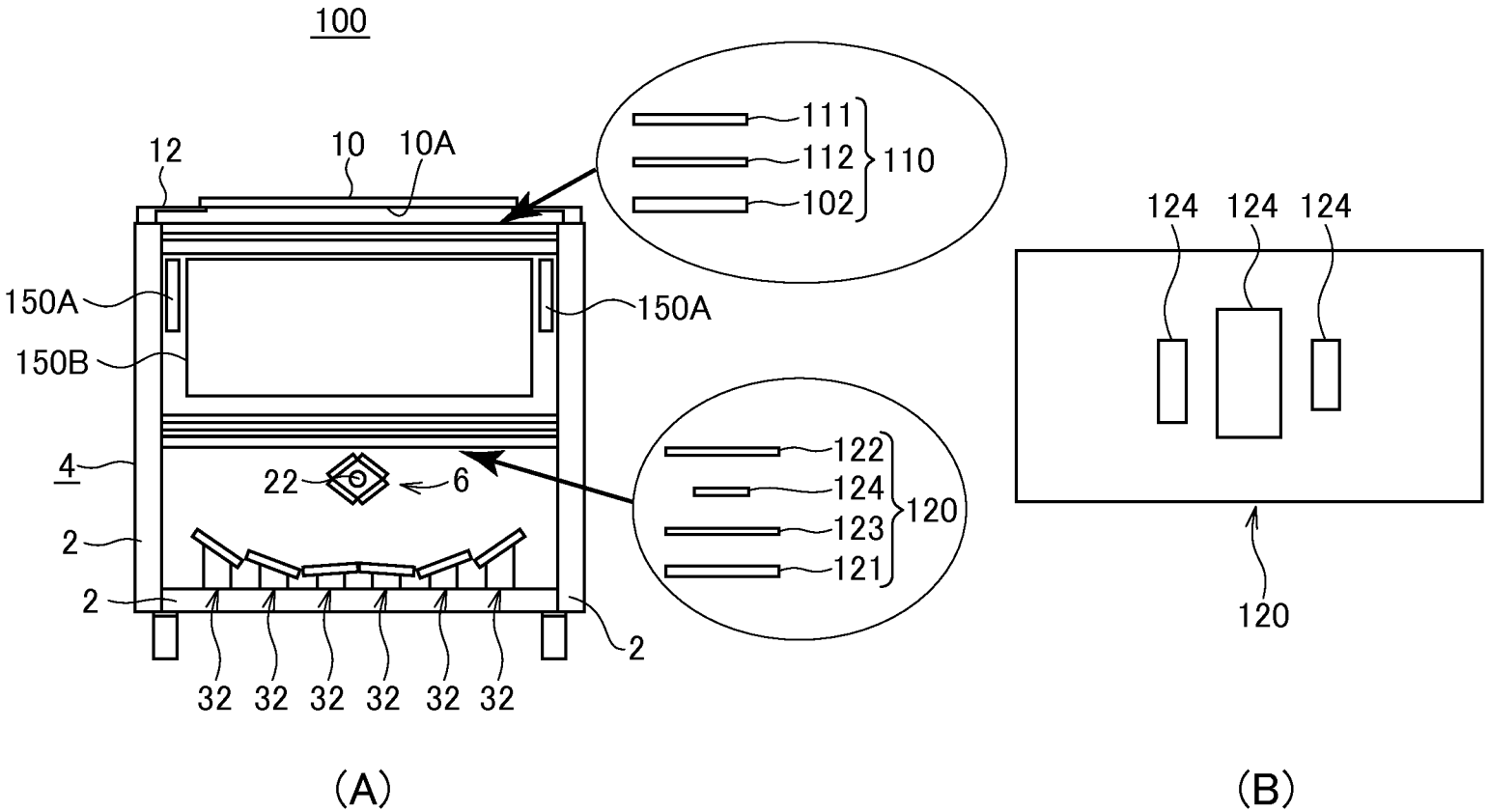

FIG. 14 is a diagram showing the construction of light diffusion members 110, 120, wherein FIG. 14(A) is a longitudinal sectional view showing the pseudo sunlight irradiating device 100 together with the enlarged light diffusion members 110, 120 and FIG. 14(B) is a diagram showing the light diffusion member 120 when viewed from the irradiation target face 10A side.

As shown in FIG. 14(A), the light diffusion unit 101 has a base plate 102 and two-layer light diffusion members 110, 120 each having a light diffusion effect, and light traveling to a site of the irradiation target face 10 at which illuminance is high is diffused by the light diffusion members 110, 120, whereby the illuminance distribution on the irradiation target face 10A is made uniform.

The base plate 102 and the light diffusion members 110 and 120 are formed of materials each of which is fixed (flat) in transmittance over the spectral range of pseudo sunlight emitted from the pseudo sunlight irradiating box 6 so that the spectrum of the pseudo sunlight is not modulated, and preferably has high transmittance.

The base plate 102 is a plate member having a rectangular shape in top view for carrying the light diffusion member 110, and formed to have such a thickness (for example, 15 mm) that it is rigid enough to prevent occurrence of slack caused by its own weight. Acrylic resin is used as the material of the base plate 102 in this embodiment. Glass may be used as this material. The base plate 102 described above is disposed at the irradiation target face 10A side of the frame body 4 so as to perfectly insulate the pseudo sunlight irradiating box 6 and the irradiation target face 10A from each other.

Each of the two-layer light diffusion members 110, 120 is constructed by laminating plural diffusion plates, and it is disposed between the irradiation target face 10A and the lamp 22 so as to be spaced from each other at only a distance D. The light diffusion effect of the light diffusion unit 101, that is, the effect of reducing the unevenness of illuminance of the irradiation target face 10A is dependent on the distance D, and the light diffusion characteristic of the light diffusion unit 101 as described above will be described below.

FIG. 15 is a diagram showing an experiment of measuring the unevenness of illuminance of the irradiation target face 10A while the position of the light diffusion members 110, 120 is changed, wherein FIG. 15(A) is a diagram showing the arrangement position of the light diffusion members 110, 120, FIG. 15(B) is a diagram showing the relationship of the positions of the light diffusion members 110, 120, the types of the diffusion plates used for the light diffusion members 110, 120 and the measurement result of the unevenness of illuminance, and FIG. 15(C) is a diagram showing the types of the diffusion lights used for the light diffusion members 110, 120.

In this experiment, the unevenness of illuminance of the irradiation target face 10A was measured while the position of the light diffusion member 110 of the irradiation target face 10A was fixed, and the position of the light diffusion member 120 at the lamp 22 side and the type of the diffusion plates for the light diffusion members 110 and 120 were changed.

The arrangement position of the light diffusion members 110, 120 is defined as the distance from the lamp 22 as shown in FIG. 15(A). FIG. 15(B) shows the measurement result of the unevenness of illuminance when the light diffusion member 110 is disposed at a distance of 400m from the lamp 22, and the diffusion member 120 is disposed at a distance of 200 mm, 300 mm or 400 mm from the lamp 22.

As shown in FIG. 15(B), there is little difference in unevenness of illuminance between a case where the light diffusion member 120 is disposed at the distance of 300 mm (experiments E5, E6, E7) and a case where the light diffusion member 120 is disposed at the distance of 400 mm (experiments E1, E2). On the other hand, as compared with a case where the light diffusion member 120 is disposed at the distance of 300 mm or 400 mm, the unevenness of illuminance is improved when the light diffusion plate 120 is disposed at the distance of 200 mm (experiments E3, e4). Accordingly, it is preferable that the light diffusion member 120 is disposed in the distance range of 200 mm to 300 mm from the lamp 22, in other words it is preferable that the distance D between the two-layer light diffusion members 110 and 120 is set to 100 mm to 200 mm (100 mm<D≤200 mm). In this embodiment, the distance D between the two-layer light diffusion members 110 and 120 is set to 200 mm.

Next, a structure of fixing the light diffusion unit 101 to the pseudo sunlight irradiating device 100 will be described.

As shown in FIGS. 11 to 13, plate-like light diffusion member receivers 103 extending in parallel to the pseudo sunlight irradiating box 6 are provided on both the side surfaces sandwiching the pseudo sunlight irradiating box 6 at an upper portion of the frame body 4 and above the pseudo sunlight irradiating box 6. Furthermore, light diffusion member receivers 104 having L-shape in section extending perpendicularly to the pseudo sunlight irradiating box 6 are provided on the side surfaces facing each other in the length direction of the pseudo sunlight irradiating box 6 at an upper portion of the frame body 4 and above the pseudo sunlight irradiating box 6.

The base plate 102 and the light diffusion plates 110 are mounted on the light diffusion member receivers 103, 104 provided at the upper portion of the frame body 4 and fixed by press clasps (not shown). The light diffusion members 120 are mounted on the light diffusion member receivers 103, 104 provided above the pseudo sunlight irradiating box 6, and fixed by press clasps (not shown).

Subsequently, the construction of the light diffusion members 110 and 120 will be described in detail with reference to FIGS. 11 to 14.

The light diffusion member 110 at the irradiation target face 10A side is mounted on the upper surface of the base plate 102 and constructed by laminating plural (two in this embodiment) light diffusion plates 111, 112. The light diffusion plate 111 at the irradiation target face 10A side is a plate-like member which is formed at such a size as to cover the whole area of an illumination light passing range through which light to be illuminated to the irradiation target face 10A passes, and it has mat-like matted diffusion faces at both the surfaces thereof. The light diffusion plate 111 of this embodiment has a thickness of about 3mm and is formed of a material having substantially the same optical characteristic as the base plate 102 (acrylic resin in this embodiment).

The light diffusion plate 112 at the base plate 102 side is a plate-like member having substantially the same size as the light diffusion plate 111, and has diffusion faces at both the surfaces thereof. One of the diffusion faces is subjected to an embossing treatment to be formed in an embossed shape. The light diffusion plate 112 is disposed so that the diffusion face having the embossed shape faces the irradiation target face 10A side. That is, the mat-like diffusion face of the light diffusion plate 111 and the embossed face of the light diffusion plate 112 are brought into contact with each other, whereby the lateral displacement of the light diffusion plate 111 can be prevented. The light diffusion plate 112 of this embodiment is formed of a material which has a thickness of about 205 μm and in which the haze corresponding to the ratio between the transmittance to parallel light beam and the transmittance to diffused light beam is equal to about 50%.

The light diffusion member 120 at the lamp 22 side is constructed by laminating plural (three in this embodiment) light diffusion plates 121 to 123 and illuminance adjusting plates 124 which is a diffusion plate for adjusting local illuminance unevenenss. The light diffusion plate 121 is constructed to be substantially identical to the light diffusion plate 111, and the two light diffusion plates 122 and 123 formed to be substantially identical to the light diffusion plate 112 are mounted on the upper surface of the light diffusion plate 121 so that the diffusion faces having the embossed shape face the irradiation target face 10A side. The illuminance adjusting plate(s) 124 which is formed to be smaller than the light diffusion plates 121 to 123 are mounted between the two light diffusion plates 122 and 123 (see FIG. 14(B)). The illuminance adjusting plate 124 is a plate-like member which has diffusion faces at both the surfaces thereof and is subjected to emboss on one surface thereof, and mounted so that the embossed surface thereof faces the lamp 22 side. Accordingly, the embossed surface of the light diffusion plate 123 at the lower side and the embossed surface of the illuminance adjusting plate 124 are brought into contact with each other, whereby the lateral displacement of the illuminance adjusting plates 124 can be prevented. In this embodiment, the illuminance adjusting plate 124 is formed of material which is equal to about 270 μm in thickness and about 90% in haze, and three illuminance adjusting plates 124 of 80 mm×400 mm, 150 mm×600 mm and 80 mm×300 mm in size respectively are provided.

As described above, the illuminance adjusting plates 124 having a relatively high light diffusion effect are provided to the light diffusion member 120 at the lamp 22 side. Therefore, light travelling to locations at which the illuminance of the irradiation target face 10A is locally high can be diffused more effectively by merely changing the position of the illuminance adjusting plate(s) 124, and thus the minute adjustment of the illuminance unevenness can be easily performed. In addition, light diffused by the illuminance adjusting plates 124 can be further diffused by the light diffusion member 110 at the irradiation target face 10A side, and thus the illuminance unevenness can be further reduced as compared with a case where the illuminance adjusting plate is mounted on the light diffusion member 110 at the irradiation target face 10A side. Furthermore, even when the illuminance unevenness varies with time or the illuminance unevenness varies because the lamp 22 is exchanged, the illuminance unevenness can be easily reduced by changing the position or size of the illuminance adjusting plate(s) 124. Furthermore, the illuminance adjusting plate 124 is disposed between the light diffusion plates 122 and 123, and thus it is unnecessary to provide a fixing member for fixing the illuminance adjusting plate 124, so that the number of parts can be reduced.

FIG. 16 is a diagram showing measurement results of the illuminance distribution of the irradiation target face 10A by the pseudo sunlight irradiating device 100 having no illuminance adjusting plate 124 mounted therein, wherein FIG. 16(A) is a diagram showing the measurement result of the illuminance distribution when the two-layer light diffusion members 110 and 120 are laminated and disposed at the irradiation target face 10A side, and FIG. 16(B) is a diagram showing the measurement result of the illuminance distribution when the two-layer light diffusion members 110 and 120 are disposed to be spaced from each other.

When the two-layer light diffusion members 110 and 120 are laminated and disposed at the irradiation target face 10A side, the illuminance is from a range of 0.8-0.85 SUN (1 SUN=1000 W/m$^2$) to a range of 1.05-1.1 SUN, and the difference therebetween is equal to 0.3 SUN as shown in FIG. 16(A).

On the other hand, when the two-layer light diffusion members 110 and 120 are disposed to be spaced from each other as in the case of the pseudo sunlight irradiating device 100, the illuminance is from a range of 0.9-0.95 SUN to a range of 1.05-1.1SUN, and the difference therebetween is equal to 0.15SUN as shown in FIG. 16(B). Therefore, the illuminance unevenness of the irradiation target face 10A is excellently reduced. Furthermore, as compared with the case where the two-layer light diffusion members 110 and 120 are laminated and disposed, the boundary of the illuminance caused by the plural reflection plates 30 (FIG. 12) is made inconspicuous.

FIG. 17 shows a measurement result of the illuminance unevenness of the irradiation target face 10A by the pseudo sunlight irradiating device 100 having the illuminance adjusting plate 124 mounted therein. In FIG. 17, the illuminance is from a range of 0.98-0.99SUN to a range of 1.01-1.02SUN, and also the illuminance unevenness is equal to about 1.8%. Accordingly, it has been demonstrated that the illuminance unevenness of the irradiation target face 10A can be excellently reduced in the pseudo sunlight irradiating device of this embodiment. Furthermore, the boundary of the illuminance caused by the plural reflection plates 30 (FIG. 12) is made more inconspicuous.

As described above, according to this embodiment, the light diffusion unit 1012 for diffusing light is provided between the lamp 22 and the irradiation target face 10a so that the illuminance distribution on the irradiation target face 10A is made uniform, and the two-layer light diffusion members 110 and 120 are disposed between the irradiation target face 10A and the lamp 22 so as to be spaced from each other, thereby constructing the light diffusion unit 101.

Light traveling to the irradiation target face 10A can be diffused and made uniform by this construction. Therefore, the illuminance unevenness of the irradiation target face 10A can be reduced with the simple construction that the two-layer light diffusion members 110 and 120 are disposed to be spaced from each other without preparing for plural kinds of transmission type optical filter plates so that the transmission type optical filter plates are arranged on virtual divisional sections of the irradiation target face 10A.

According to this embodiment, the plural reflection plates 30 are disposed in parallel at the opposite side to the irradiation target face 10A with respect to the lamp 22 to form the reflection face 8, direct light which is directly emitted from the lamp 22 and reflection light reflected from the reflection face 8 are applied to the irradiation target face 10A, and the two-layer light diffusion members 110 and 120 are spaced from each other at only a distance D at which the boundaries of the plural reflection plates 30 are inconspicuous.

According to this construction, even when the plural reflection plates 30 are arranged in parallel to form the reflection face 8, the boundaries of the plural reflection plates 30 can be made inconspicuous. That is, the reflection face 8 can be formed by the plural reflection plates 30, and thus as compared with a case where the reflection face 8 is formed by bending one reflection plate, the reflection face 8 can be formed with a simpler construction, and also reduction of illuminance of the irradiation target face 10A can be easily compensated by adjusting the reflection angles (tilt angles) of the reflection plates 30.

Furthermore, according to this embodiment, the light diffusion member 120 at the lamp 22 side out of the two-layer light diffusion members 110 and 120 is provided with the illuminance adjusting plate 124 for adjusting the local illuminance unevenness.

According to this construction, the fine adjustment of the illuminance unevenness can be easily performed by disposing the illuminance adjusting plate 124 at a site at which the illuminance is locally high. Furthermore, the illuminance adjusting plate 124 is mounted on the light diffusion member

120 at the lamp 22 side, whereby light diffused by the illuminance adjusting plate 124 can be diffused by the light diffusion member 110 at the irradiation target face 10A side. Therefore, the illuminance unevenness can be more greatly reduced as compared with the case where the illuminance adjusting plate is mounted on the light diffusion plate 110 at the irradiation target face 10A side.

Furthermore, according to this embodiment, the auxiliary reflection faces 150A and 150B for reflecting to the irradiation target face 10A light which is a part of light emitted from the lamp 22 and travels to a site out of the irradiation target face 10A are disposed between the lamp 22 of the side surface of the pseudo sunlight irradiating device 100 and the irradiation target face 10A.

According to this construction, the light diffused by the light diffusion plate 120 at the lamp 22 side can be reflected. Therefore, as compared with the case where the auxiliary reflection face is disposed between the lamp 22 and the reflection face 8, light can be diffused and made uniform while the light is made to travel to a desired site at which the reduction of the illuminance of the irradiation target face 10A should be compensated. Furthermore, the reduction of the illuminance of the irradiation target face 10A can be compensated by effectively using the light which is shielded by the light shielding plate disposed on the side surface of the frame body 4, and also the pseudo sunlight irradiating device 100 can be miniaturized as compared with the case where the auxiliary reflection face is disposed at the lower portion the frame body 4.

The above embodiments show a mode according to the present invention, and any modification and application may be made without departing from the subject matter of the present invention.

In the above-described embodiments, the pseudo sunlight irradiating device is used as the illuminating device according to the present invention, however, the present invention is not limited to this style. That is, the transmission light amount adjusting unit or the light diffusion unit according to the present invention may be provided to any illuminating device insofar as the illuminating device reduces the illuminance unevenness of the irradiation target face. For example, an ultraviolet curing device may be used as the illuminating device. The ultraviolet curing device uniformly applies ultraviolet ray to a surface coated with ultraviolet curable material such as UV ink, UV coating, UV adhesive agent or the like to cure the ultraviolet curable material, and it has been applied to various surface treatment systems such as print, upper surface coating, adhesion of semiconductors, electrical parts, optical parts, attachment of liquid crystal panels, etc. An ultraviolet curable device which can perform a surface treatment for suppressing the unevenness more greatly can be implemented by providing this ultraviolet curable device with the transmission light amount adjusting unit or the light diffusion unit according to the present invention.

DESCRIPTION OF REFERENCE NUMERALS

1, 100 pseudo sunlight irradiating device (illuminating device)
6 pseudo sunlight irradiating box
8 reflection face
10 irradiation target body
10A irradiation target face
22 lamp (light source)
30 reflection plate
50, 150A, 150B auxiliary reflection face
60 transmission light adjusting unit
62 base plate
64 light transmission plate laminate member
65 light transmission plate
66 surface film (press member)
68 spacer light transmission plate (one light transmission plate)
70 spacer plate (spacer member)
101 light diffusion unit
110 light diffusion member
120 light diffusion member
124 illuminance adjusting plate
D distance
F pseudo sunlight
K wavelength range
R illumination light passing range

The invention claimed is:

1. An illuminating device having a light source for illuminating an irradiation target face with light, the illuminating device comprising:

a transmission light amount adjusting unit arranged between the light source and the irradiation target face, the transmission light amount adjusting unit configured to adjust a transmission light amount so as to make a uniform illuminance distribution on the irradiation target face, wherein the transmission light amount adjusting unit comprises a light transmission plate laminate member having a plurality of light transmission plates that are constant in transmittance in a wavelength range of light to be transmitted therethrough, the plurality of light transmission plates are stacked by a stack number of the light transmission plates corresponding to an adjustment amount of the transmission light amount so as to reflect incident light at each boundary of front and back surfaces of each of the plurality of light transmission plates of the transmission light amount adjusting unit, and each of the plurality of light transmission plates is configured to be thinner in accordance with the stack number so that the whole thickness of the light transmission plate laminate member is constant.

2. The illuminating device according to claim 1, wherein the light transmission plate laminate member is disposed at each position where the transmission light amount is to be adjusted, a single light transmission plate of the plurality of light transmission plates is configured to have the same thickness as the light transmission plate laminate member is disposed in a gap between the light transmission plate laminate members, the light transmission plate laminate members and the single light transmission plate of the plurality of light transmission plates are paved in a range through which the light to be illuminated to the irradiation target face passes, and a spacer member for preventing positional displacement of the light transmission plate laminate members and the single light transmission plate is provided around a range paved with the light transmission plate laminate members and the single light transmission plate.

3. The illuminating device according to claim 2, further comprising:

a press member that covers and presses the surface of each of the light transmission plate laminate members and the single light transmission plate of the plurality of light transmission plates.

4. The illuminating device according to claim 2, wherein an auxiliary reflection face for reflecting to the irradiation target face light which is a part of light emitted from the light source and travels to a location out of the irradiation target face is disposed between the light source at the side of the device and the irradiation target face.

5. The illuminating device according to claim 3, wherein an auxiliary reflection face for reflecting to the irradiation target face light which is a part of light emitted from the light source and travels to a location out of the irradiation target face is disposed between the light source at the side of the device and the irradiation target face.

6. The illuminating device according to claim 1, wherein an auxiliary reflection face for reflecting to the irradiation target face light which is a part of light emitted from the light source and travels to a location out of the irradiation target face is disposed between the light source at the side of the device and the irradiation target face.

7. An illuminating device having a light source for illuminating an irradiation target face with light, comprising:

a light diffusion unit for diffusing light so as to make a uniform illuminance distribution on the irradiation target face, the light diffusion unit is provided between the light source and the irradiation target face, wherein the light diffusion unit comprises a first and second multi-layer light diffusion spaced from each other member, the first multi-layer light diffusion member is spaced apart from the second multi-layer light diffusion member, the first multi-layer light diffusion member comprises an illuminance adjusting plate that is configured to be changeable in position or size for adjusting local illuminance unevenness, and the first multi-layer light diffusion member is located at the light source side.

8. The illuminating device according to claim 7, wherein a plurality of reflection plates are arranged in parallel at an opposite side to the irradiation target face with respect to the light source to constitute a reflection face, direct light emitted directly from the light source and reflection light reflected from the reflection face are applied to the irradiation target face, and the first and second multi-layer light diffusion members are spaced from each other at such a distance that boundaries of the plurality of reflection plates are inconspicuous.

9. The illuminating device according to claim 8, wherein an auxiliary reflection face for reflecting to the irradiation target face light which is a part of light emitted from the light source and travels to a location out of the irradiation target face is disposed between the light source at the side of the device and the irradiation target face.

10. The illuminating device according to claim 7, wherein an auxiliary reflection face for reflecting to the irradiation target face light which is a part of light emitted from the light source and travels to a location out of the irradiation target face is disposed between the light source at the side of the device and the irradiation target face.

* * * * *